US008215867B2

(12) United States Patent
Juzva et al.

(10) Patent No.: US 8,215,867 B2
(45) Date of Patent: Jul. 10, 2012

(54) TRENCH COMPACTING APPARATUS

(75) Inventors: Andrew Juzva, Dandenong (AU); Francis J Dawson, Dandenong (AU)

(73) Assignee: Armagh (Vic.) Pty Ltd, Keysborough, Victoria (AU)

( * ) Notice: Subject to any disclaimer, the term of this patent is extended or adjusted under 35 U.S.C. 154(b) by 86 days.

(21) Appl. No.: 12/227,813

(22) PCT Filed: Apr. 27, 2007

(86) PCT No.: PCT/AU2007/000540

§ 371 (c)(1), (2), (4) Date: Nov. 26, 2008

(87) PCT Pub. No.: WO2007/137324

PCT Pub. Date: Dec. 6, 2007

(65) Prior Publication Data

US 2009/0137373 A1 May 28, 2009

(51) Int. Cl.
*E01C 19/26* (2006.01)

(52) U.S. Cl. ..... 404/121; 404/122; 404/124; 404/127; 404/128

(58) Field of Classification Search ..... 404/117, 404/119–126, 133.05–133.2
See application file for complete search history.

(56) References Cited

U.S. PATENT DOCUMENTS

| | | | | |
|---|---|---|---|---|
| 204,988 | A * | 6/1878 | McColm | 172/548 |
| 2,146,101 | A * | 2/1939 | Weber | 404/121 |
| 2,754,734 | A * | 7/1956 | Gardner | 404/124 |
| 2,895,390 | A * | 7/1959 | Gardner | 404/124 |
| 3,259,036 | A * | 7/1966 | Peterson et al. | 404/121 |
| 3,269,285 | A * | 8/1966 | Lathers | 404/124 |
| 3,274,908 | A * | 9/1966 | Grant et al. | 404/121 |
| 3,297,096 | A * | 1/1967 | Wooldridge | 172/464 |
| 3,318,211 | A * | 5/1967 | Grace | 404/124 |
| 3,650,185 | A * | 3/1972 | Takata | 404/121 |

(Continued)

FOREIGN PATENT DOCUMENTS

DE 3427675 A1 2/1985

(Continued)

OTHER PUBLICATIONS

PCT International Search Report, PCT/AU2007/000540 dated Jun. 2, 2007.

*Primary Examiner* — Raymond W Addie
(74) *Attorney, Agent, or Firm* — TraskBritt

(57) ABSTRACT

A compacting device (40) for attachment to an earthmoving machine (2) to compact a substrate is described. The compacting device (40) includes a plurality of wheel assemblies (41, 42, 43) mounted for rotation in bearings (46). A support is also provided, having a base part (48) that is adapted to be mounted to the earthmoving machine (2). One or more bearing support members (47) extend from the base part (48) and between the wheel assemblies (41, 42, 43) to support the bearings (46). Each wheel assembly (41, 42, 43) includes a set of ground-contacting feet (44) secured to and peripherally spaced apart around a rim portion of the wheel assembly (41, 42, 43). In this arrangement, when the device (40) is rolled over the substrate a first foot of said set of ground engaging feet (44) contacts the substrate between axial width limits that differ from axial width limits of a second foot of said set of ground engaging feet (44).

38 Claims, 22 Drawing Sheets

U.S. PATENT DOCUMENTS

| | | | | | |
|---|---|---|---|---|---|
| 3,822,957 | A | * | 7/1974 | Caron et al. | 404/121 |
| 3,823,983 | A | * | 7/1974 | Peterson | 301/43 |
| 3,922,106 | A | * | 11/1975 | Caron et al. | 404/121 |
| 4,269,535 | A | * | 5/1981 | Schultz | 404/117 |
| 4,278,368 | A | * | 7/1981 | Livesay | 404/121 |
| 4,411,081 | A | * | 10/1983 | King | 404/121 |
| 4,530,620 | A | * | 7/1985 | McCartney | 404/121 |
| 4,632,599 | A | | 12/1986 | Sadahiro | |
| 4,723,870 | A | * | 2/1988 | Martinez | 404/121 |
| 4,913,581 | A | * | 4/1990 | Weiler | 404/117 |
| 4,950,102 | A | * | 8/1990 | Zeitz | 404/121 |
| D386,191 | S | * | 11/1997 | Bruns | D15/28 |
| 5,967,242 | A | * | 10/1999 | Caron et al. | 172/817 |
| 6,869,250 | B2 | * | 3/2005 | Moyna | 404/124 |
| 7,198,333 | B1 | * | 4/2007 | Freeman | 301/43 |
| 2005/0194154 | A1 | * | 9/2005 | Hester | 172/1 |

FOREIGN PATENT DOCUMENTS

| | | | |
|---|---|---|---|
| DE | 29714595 | U1 | 11/1997 |

* cited by examiner

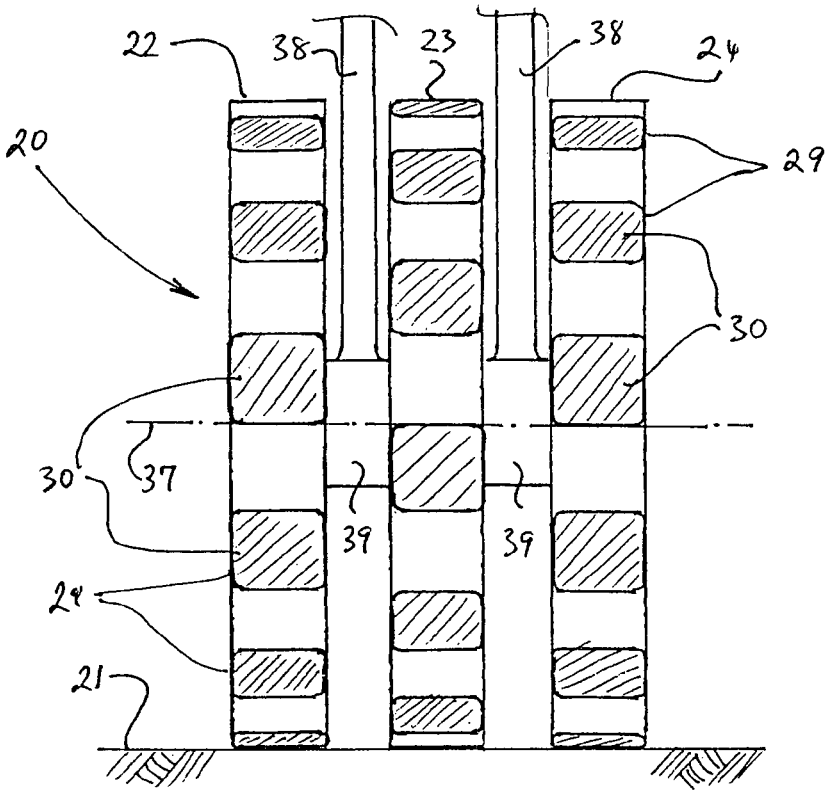
FIG. 2
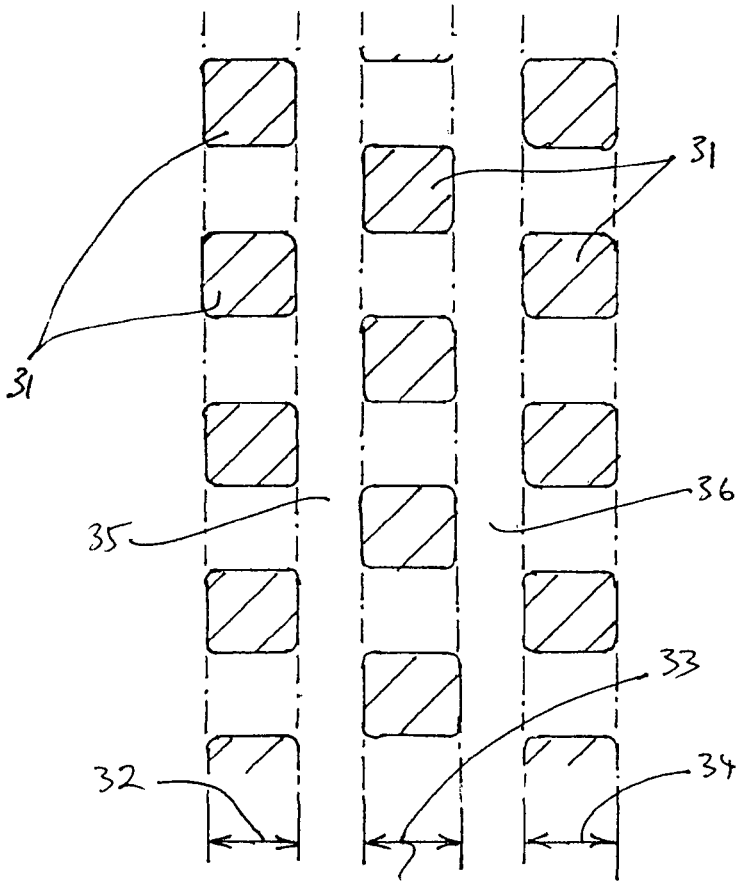

TRENCH COMPACTING APPARATUS

CROSS-REFERENCE TO RELATED APPLICATIONS

The present application claims priority from Australian Provisional Patent Application No 2006902915 filed on 31 May 2006, the contents of which is incorporated herein by reference.

FIELD OF THE INVENTION

This invention relates to a compacting wheel apparatus of the type fitted to earthmoving machinery for compacting soil, particularly in trenches.

BACKGROUND

It is a requirement in cable- and pipe laying, and civil engineering in general, to compact soil in a trench, or other confined space, to return the soil to its original grade. For reasons of cost, safety and consistency of results, it is normal to fit a rotatable wheel or drum to a suitable earthmoving machine, the wheel or drum being rolled back and forth over the soil area to be compacted until a suitable level of compaction is obtained.

FIG. 1 shows one such arrangement. A wheel-type compacting device 1 is mounted to a backhoe excavator 2 in place of the usual bucket. The device 1 is able to rotate freely about an axis 3 that is parallel to the axes 4 and 5 about which the backhoe's dipper (sometimes alternatively called stick) 6 and boom 7 rotate. The backhoe operator positions excavator 2 so that axes 4 and 5 are perpendicular to the length of a trench 8. The operator can then readily position the device 1 at the base of the trench, and by operation of boom 7 and stick 6, roll the device backwards and forwards along the trench to compact the soil therein. The device 1 is typically provided with radially projecting feet 9 to enhance the compaction effect but may also take the form of a plain-surfaced wheel or drum.

In some circumstances vibration devices may be employed with the device 1 for better compaction, and sometimes no vibration capability is provided, reliance being placed simply on repetitive pressing downward of the soil surface by the feet of the wheel.

Other types of machines may be used for mounting the compacting devices such as device 1. For example, device 1 may be mounted to other types of excavators, such as telescopic-boom excavators (sold by Gradall Inc., USA), and to the boom-and-stick backhoe arrangements that are often fitted to the rear of wheeled loaders. With suitable adaptors, front-end loaders of the articulated or skid steer type may also be fitted with compacting devices.

Compacting devices that comprise a single drum with feet projecting therefrom and which is supported for rotation between fork arms can lead to difficulties in compacting soil adjacent the walls of a trench. This may be due to the fact that the fork arms are of a size that can prevent the drum accessing the soil at the perimeter of the trench, adjacent the longitudinal walls of the trench. It is therefore known to provide compacting devices, such as device 1, that employ several individual wheel disks 10 on a common shaft, with supporting members 11 arranged therebetween. In the arrangement as shown in FIG. 1, supporting members 11 are secured to a structure 12 releasably attached to the stick 6 and provide support for an axle (not shown) on which are mounted the wheel disks 10.

However, devices of this type, have their own problems. Gaps are needed between some wheel disks 10 to provide clearance for the support members 11 and the ground below such gaps receives no significant compaction. Therefore, to provide adequate and even compaction over the whole width of a trench floor, it may be necessary to shift the device 1 laterally one or more times to ensure that all the soil within the trench is compacted. This can be a time consuming process that requires significant operator skill in manoeuvring the machine.

Therefore, there is a need to provide a compacting device that provides improved soil compaction in a relatively simple manner.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

In a first aspect, the invention provides a compacting device for attachment to an earthmoving machine to compact a substrate, including:

a plurality of wheel assemblies mounted for rotation together in bearings; and a support having a base adapted to be mounted to the earthmoving machine and one or more bearing support members that extend from the base and between the wheel assemblies to support the bearings;

wherein each wheel assembly includes a set of ground-contacting feet secured to and peripherally spaced apart around a rim portion of the wheel assembly such when the device is rolled over the substrate a first foot of the set of ground engaging feet contacts the substrate between axial width limits that differ from axial width limits of a second foot of the set of ground engaging feet.

In one embodiment, the axial width limits of the first foot partially overlap the axial width limits of the second foot. The first and second feet may be peripherally adjacent members of said set of feet.

The first and second feet may be comprised in a multi-foot pad secured to the wheel assembly. The multi-foot pad may comprise two feet only of the set of ground engaging feet. Conveniently, the first and second feet may be integrally formed in said multi-foot pad.

The multi-foot pad may be secured to the wheel assembly by at least one of welding, bolting, riveting, and pinning by means of at least one pin. In another form, the multi-foot pad may be formed integrally with the wheel assembly by casting or the like.

In another embodiment, for ease of fitting, the multi-foot pad has locating surfaces that, when the multi-foot pad is placed on the wheel assembly for securing thereto, bear against the wheel assembly so as to correctly position the feet radially and/or axially on the rim portion of the wheel assembly. This arrangement may be particularly convenient when the multi-foot pad is to be secured by welding.

The multi-foot pad may have a groove within which the rim portion of the wheel assembly is received so as to locate the multi-foot pad on the wheel assembly axially and radially.

In another embodiment, when the multi-foot pad is secured to the rim portion of the wheel assembly, the axially leftmost width limit of the first foot is on an opposite side of the rim portion of the wheel assembly from the axially rightmost width limit of the second foot.

The first and second feet of the multi-foot pad may have approximately the same shape as each other, save for being oppositely handed in an axial direction, and wherein when the multi-foot pad is secured to the wheel assembly the first and second feet may be approximately equally displaced in opposite axial directions from the rim portion of the wheel assembly.

At least one of the wheel assemblies may include an endmost wheel assembly that may be secured to an outermost wheel assembly of the device to increase its working width.

In another embodiment, the compaction device or the machine to which it is mounted may be provided with means for vibrating the wheel assemblies to enhance the compaction effect where required.

In a further aspect, the invention provides a multi-foot ground engaging pad for a compacting device of the type having a wheel assembly comprising one or more wheels adapted to be rolled over a substrate to be compacted, the pad including a plurality of ground engaging feet integrally formed on a base that is securable to a rim portion of the one or more wheels whereupon said feet are spaced peripherally on said wheel.

In an embodiment of this aspect, during rolling of the wheel assembly on the substrate, a first ground engaging foot on the pad contacts the substrate between axial width limits that differ from axial width limits of a second ground engaging foot on the pad.

In one form, the axial width limits of the first ground engaging foot may partially overlap the axial width limits of the second ground engaging foot.

In one embodiment, the multi-foot pad may comprise two ground engaging feet only. The multi-foot pad may be securable to the wheel by at least one of welding, bolting, riveting, and pinning by means of at least one pin.

The multi-foot ground engaging pad may have locating surfaces that, when the pad is placed on the wheel for securing thereto, bear against the wheel so as to correctly position the ground engaging feet radially and/or axially on the wheel. A groove may be provided within which an outer rim of the wheel may be received so as to locate the pad on the wheel axially and radially.

The multi-foot pad may be so proportioned that when the pad is secured to the wheel the axially leftmost width limit of the first foot is on an opposite side of a rim portion of the wheel from the axially rightmost width limit of the second foot. The first and second ground engaging feet of the pad may have approximately the same shape as each other save for being oppositely handed in an axial direction. In this regard, when the pad is secured to said wheel the first and second feet may be approximately equally displaced in opposite axial directions from the rim portion of the wheel.

In a still further aspect, the invention provides a method for compacting soil including the steps of:

securing a compacting device as disclosed herein to an earthmoving machine; and using the machine to roll the device back and forth on a surface of the soil.

In one embodiment of this aspect of the invention, the earthmoving machine may include a backhoe mechanism having a boom and a dipper and the device may be secured to a free end of the dipper.

According to yet another aspect, the present invention provides a compacting device for attachment to an earthmoving machine to compact a substrate, the compacting device including:

a base adapted to be mounted to said earthmoving machine;

one or more support members extending from the base;

one or more bearings, the or each bearing being mounted to an end of the one or more support members;

a shaft rotatably supported within the one or more bearings; and a plurality of wheel assemblies mountable to said shaft such that said one or more support members extend between said wheel assemblies;

wherein each wheel assembly includes a plurality of ground-contacting feet spaced apart around the periphery of the wheel assembly, said feet being alternately displaced laterally towards opposing sides of the wheel assembly such that when said wheel assemblies are rolled over a substrate surface said feet contact said substrate surface and compact said substrate.

In an embodiment of this aspect of the invention, the wheel assemblies are mountable to the shaft such that the ground contacting feet of adjacent wheel assemblies are circumferentially staggered.

In one form, at least two of the wheel assemblies may be directly mounted to the shaft. At least one wheel assembly may be mounted to one of the wheel assemblies directly mounted to the shaft.

Each ground contacting foot may be formed integral with at least one adjacent ground contacting foot to form a multi-foot pad attached to a rim portion of each wheel assembly. The multi-foot pad may have two ground contacting feet only. The multi-foot pad may be secured to the rim portion of the wheel assembly by at least one of welding, bolting, riveting, and pinning by means of at least one pin.

In one form, the multi-foot pad may have locating surfaces that, when the multi-foot pad is placed on the rim portion of the wheel assembly for securing thereto, bear against he rim portion of the wheel assembly so as to correctly position the ground contacting feet radially and/or axially on the rim portion of the wheel assembly. In another form, the multi-foot pad may have a groove within which the rim portion of the wheel assembly may be received so as to locate the multi-foot pad on the rim portion of the wheel assembly axially and radially.

In another embodiment of this aspect of the invention, the first and second feet of the multi-foot pad may have substantially the same shape. In this regard, when the multi-foot pad is secured to the rim portion of the wheel assembly the first and second feet may be approximately equally displaced in opposite lateral directions from the rim portion of the wheel assembly.

According to yet another aspect, the present invention provides a compacting device for attachment to an earthmoving machine to compact a substrate, the compacting device including:

a base adapted to be mounted to said earthmoving machine;

one or more support members extending from the base;

one or more bearings, the or each bearing being mounted to an end of the one or more support members;

a shaft rotatably supported within the one or more bearings; and a plurality of wheel assemblies mounted on said shaft such that said one or more support members extend between said wheel assemblies, each wheel assembly having a plurality of ground-contacting feet spaced apart around the periphery of the wheel assembly such that when said wheel assemblies are rolled over the substrate surface said feet contact said substrate surface and compact said substrate, wherein, one or more additional wheel assemblies are removably mounted to one or more of the plurality of wheel assemblies mounted on the shaft.

In an embodiment of this aspect of the invention, the one or more additional wheel assemblies are removably mounted to an end wheel assembly mounted on the shaft. The one or more additional wheel assemblies may be removably mounted to a hub that is removably mounted to an end wheel assembly mounted on the shaft.

The hub may comprise a first mounting disc for mounting said hub to a wheel disc of an end wheel assembly mounted on the shaft and a second mounting disc to which said additional wheel assembly is mounted. The first and second mounting discs may have a plurality of holes formed therethrough to receive one or more fasteners for facilitating mounting of the hub to the end wheel assembly and mounting of the additional wheel assembly to the hub. The plurality of holes may be formed around the periphery of the first and second mounting discs. Corresponding holes formed around the periphery of the first and second mounting discs may be offset such that the plurality of ground-contacting feet spaced apart around the periphery of the additional wheel assembly are circumferentially staggered with respect to the plurality of ground-contacting feet spaced apart around the periphery of the end wheel assembly when the additional wheel assembly is mounted to the end wheel assembly.

Other aspects and features will become apparent from the following detailed description.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

By way of example only, the invention is now described with reference to the accompanying drawings:

FIG. 2 is a schematic diagram showing (upper part) a rear view of a compacting wheel and (lower part) a plan view of areas of a surface compacted by passage of the compacting wheel when rolling over a substrate;

DETAILED DESCRIPTION OF PREFERRED EMBODIMENTS

Figure 1:
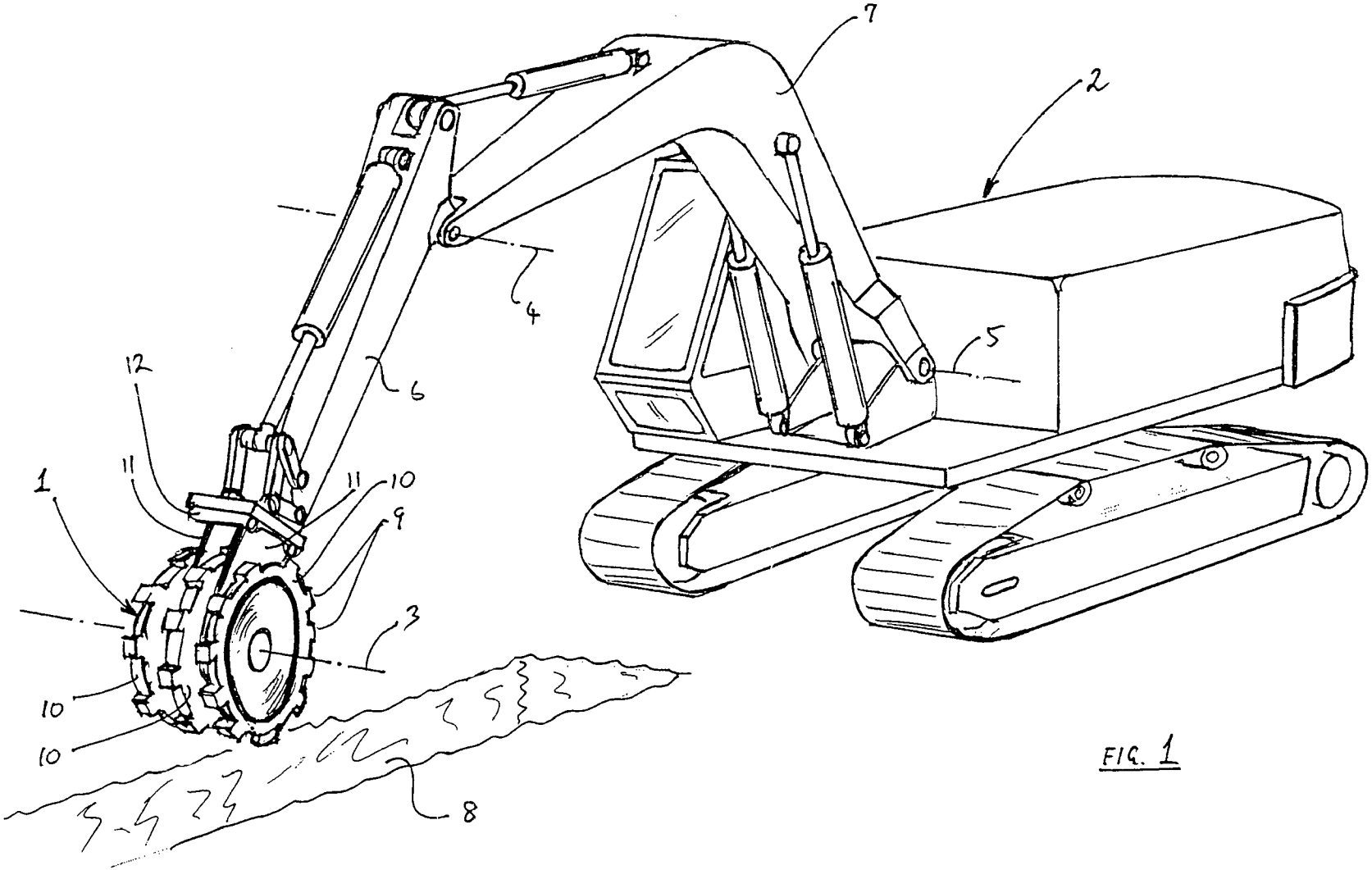
FIG. 1 is a perspective view of a backhoe excavator fitted with a compacting wheel of known type.

FIG. 1 shows a wheel-type compacting device 1 mounted on a backhoe excavator 2 and has been discussed above. The present invention provides an improved compacting device usable in the same way as compacting device 1.

FIG. 2 shows a compacting device 20 such as that shown in the prior art device of FIG. 1. In the upper part of FIG. 2, a rear elevation of a compacting device 20 is shown, rolling on a substrate 21. Device 20 comprises three wheels 22, 23 and 24, that are mounted on a single shaft (not shown) so as to rotate together rather than independently. The shaft is in turn supported for rotation in bearing assemblies 39 mounted to a pair of support members 38 located between wheels 22 and 23, and 23 and 24 respectively. Wheel assemblies 22, 23 and 24 each have compacting feet 29 whose outer surfaces 30 (all shown shaded) contact substrate 21 as the device 20 is rolled over the substrate 21. No other constructional details of wheel assemblies 22, 23 and 24 are shown. The lower part of FIG. 2 shows, in plan view, a portion of substrate 21 after the device 20 has been rolled over the substrate in a single rolling pass, with the areas 31 that are contacted by surfaces 30 indicated by shading.

It is apparent from FIG. 2 that a rolling pass of device 20 over substrate 21 provides compaction in three strips 32, 33 and 34, but does not directly compact substrate 21 in the two intervening strips 35 and 36. These strips are not directly compacted by the device due to the support members 38 (similar to members 11 in FIG. 1) being provided between adjacent pairs of wheel assemblies 22, 23 and 24 to support bearing assemblies 39.

In practice, to compact the whole area of substrate 21 (which could be the floor of a trench) adequately and evenly, device 20 would need to be moved axially (i.e. in the direction of rotation axis 37 of device 20) from time to time and multiple rolling passes would need to be made at each axial position. This process also allows compaction to be carried out at the edges of a trench, despite the fact that the device 20 would in general be narrower than the trench width. As will be appreciated, in order to achieve effective soil compaction using such a process, significant operator skill and time is required.

Figure 3:
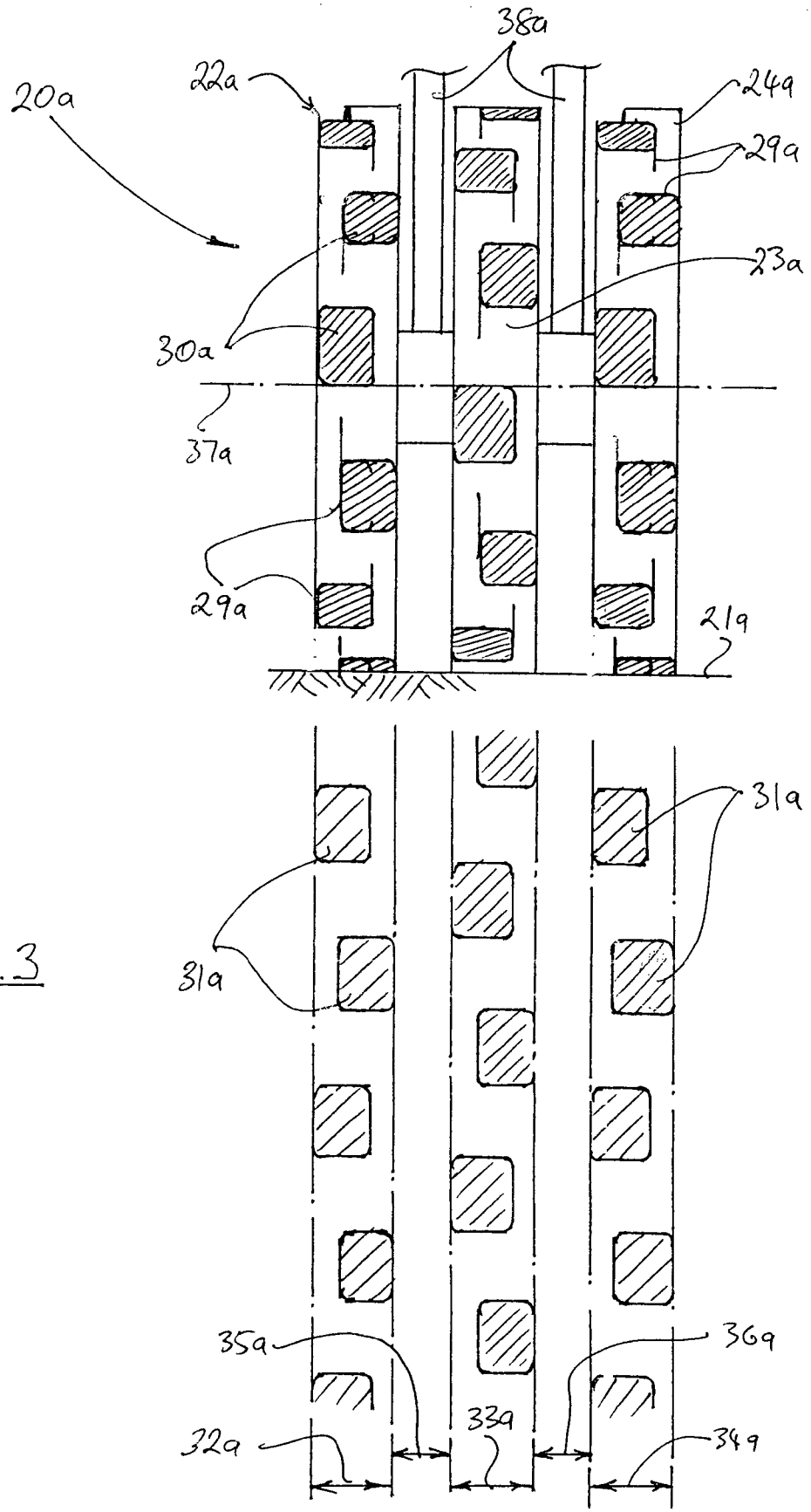
FIG. 3 is a schematic diagram showing (upper part) a rear view of a further compacting wheel and (lower part) a plan view of areas of a surface compacted by passage of the compacting wheel when rolling over a substrate.

According to the present invention, it has been found that, in at least some ground conditions, the performance of a device, such as device 20, can be enhanced by making the individual feet on each wheel assembly narrower (in the axial direction) while maintaining the width of the strip contacted by each wheel assembly by offsetting some feet axially from others. One embodiment of such an arrangement is shown in FIG. 3. In order to facilitate direct comparison of the device of the present invention as shown in FIG. 3, and that of the prior art, as shown in FIG. 2, the same item numbers with the suffix 'a' have been used for equivalent items. The effectiveness of the device 20*a*, as shown in FIG. 3, is thought to arise because the total area of the device 20*a* in contact with the substrate 21*a* is decreased, so leading to a higher level of compaction for a given downward force on the device 20*a*. In successive passes of the device 20*a* over the substrate 21*a*, particularly if the device 20*a* is lifted clear of the substrate 21*a* at the end of each pass, the feet 29*a* will not in general touch the substrate at identical positions as in previous passes, so that strips 32*a*, 33*a* and 34*a* of the same width as strips 32, 33 and 34 can be compacted, thereby providing improved compaction of the soil in these regions.

Figure 4:
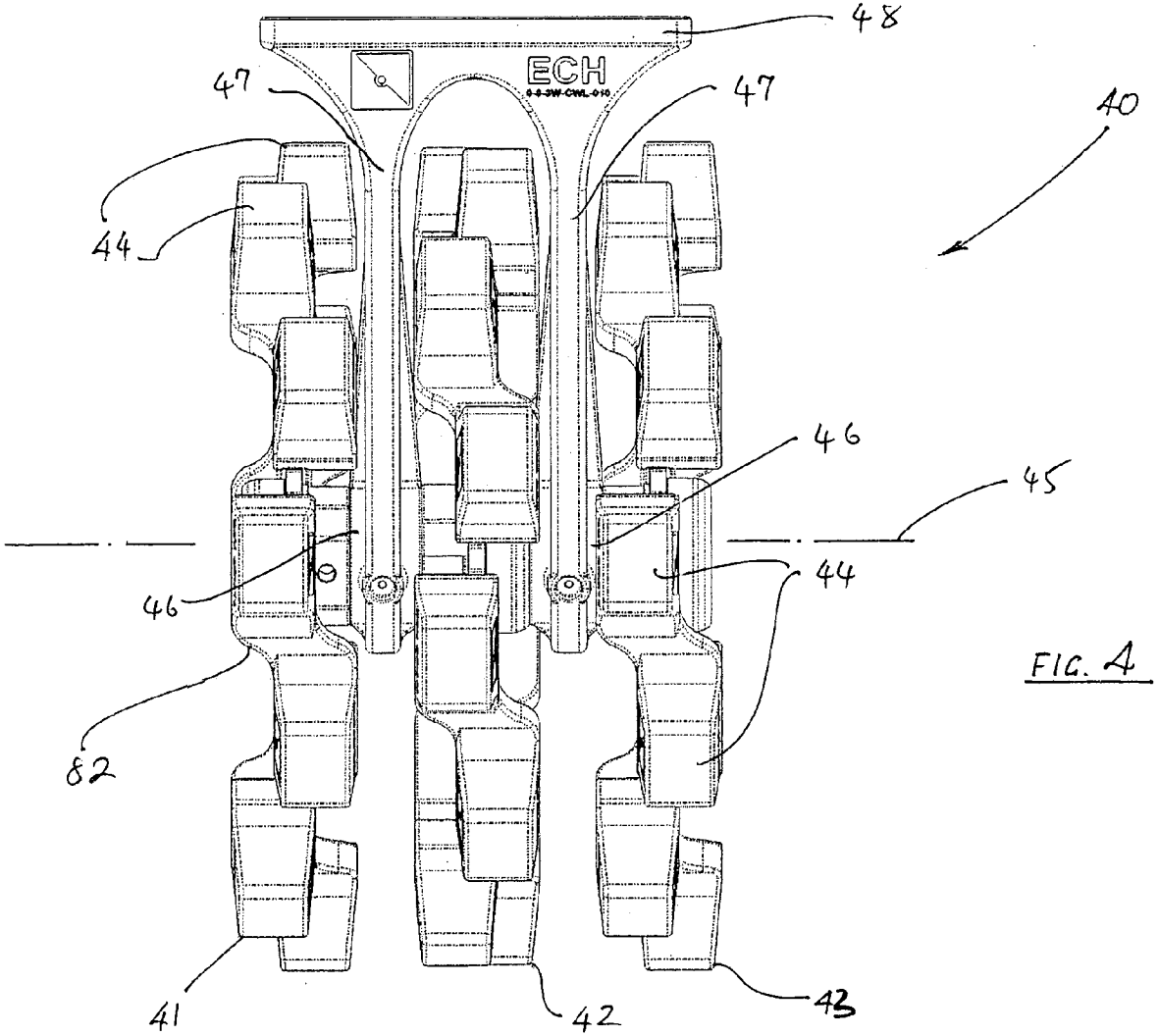
FIG. 4 is an elevation of three-wheel embodiment of the invention.
Figure 5:
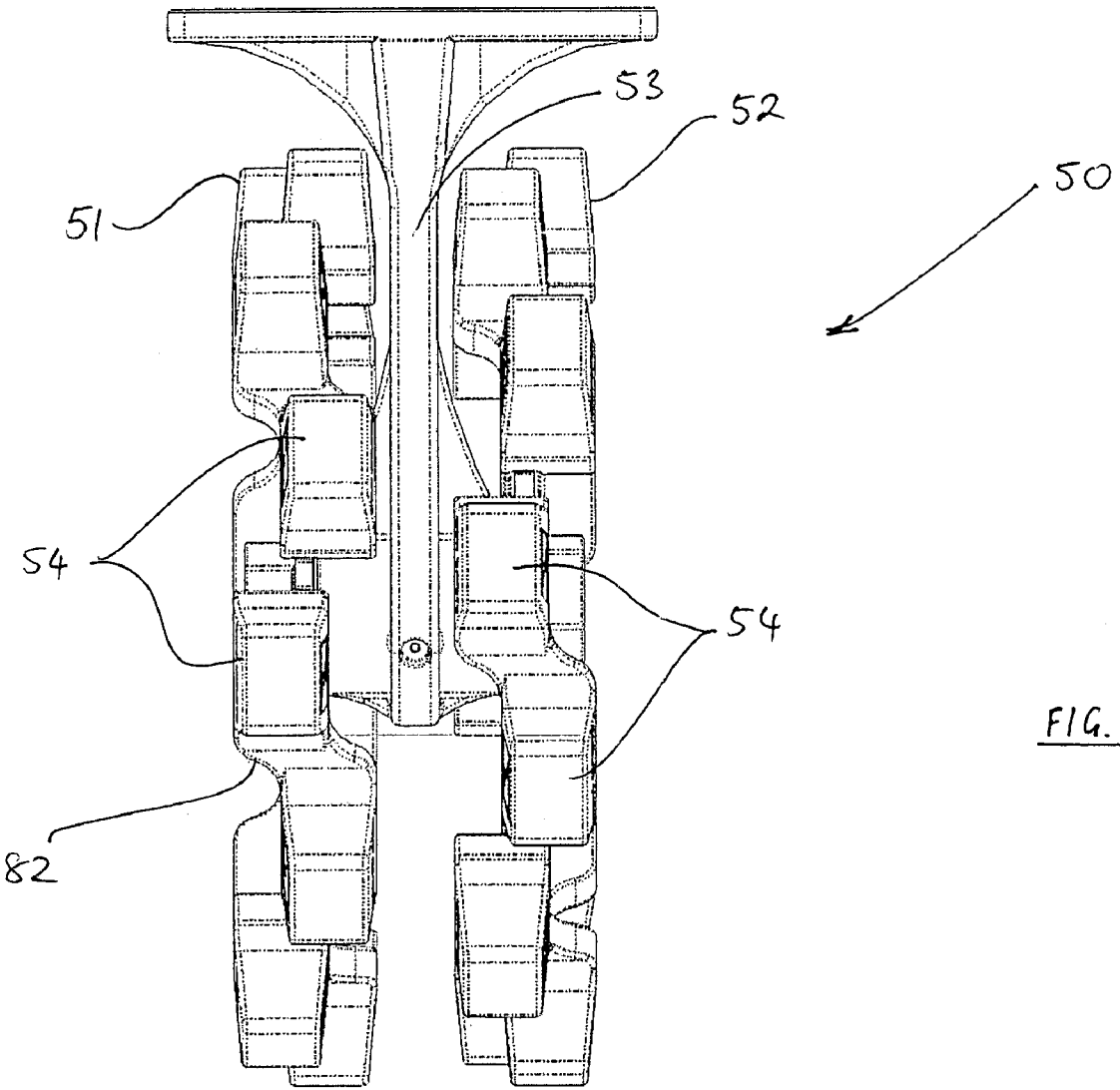
FIG. 5 is an elevation of a two-wheel embodiment of the invention.
Figure 6:
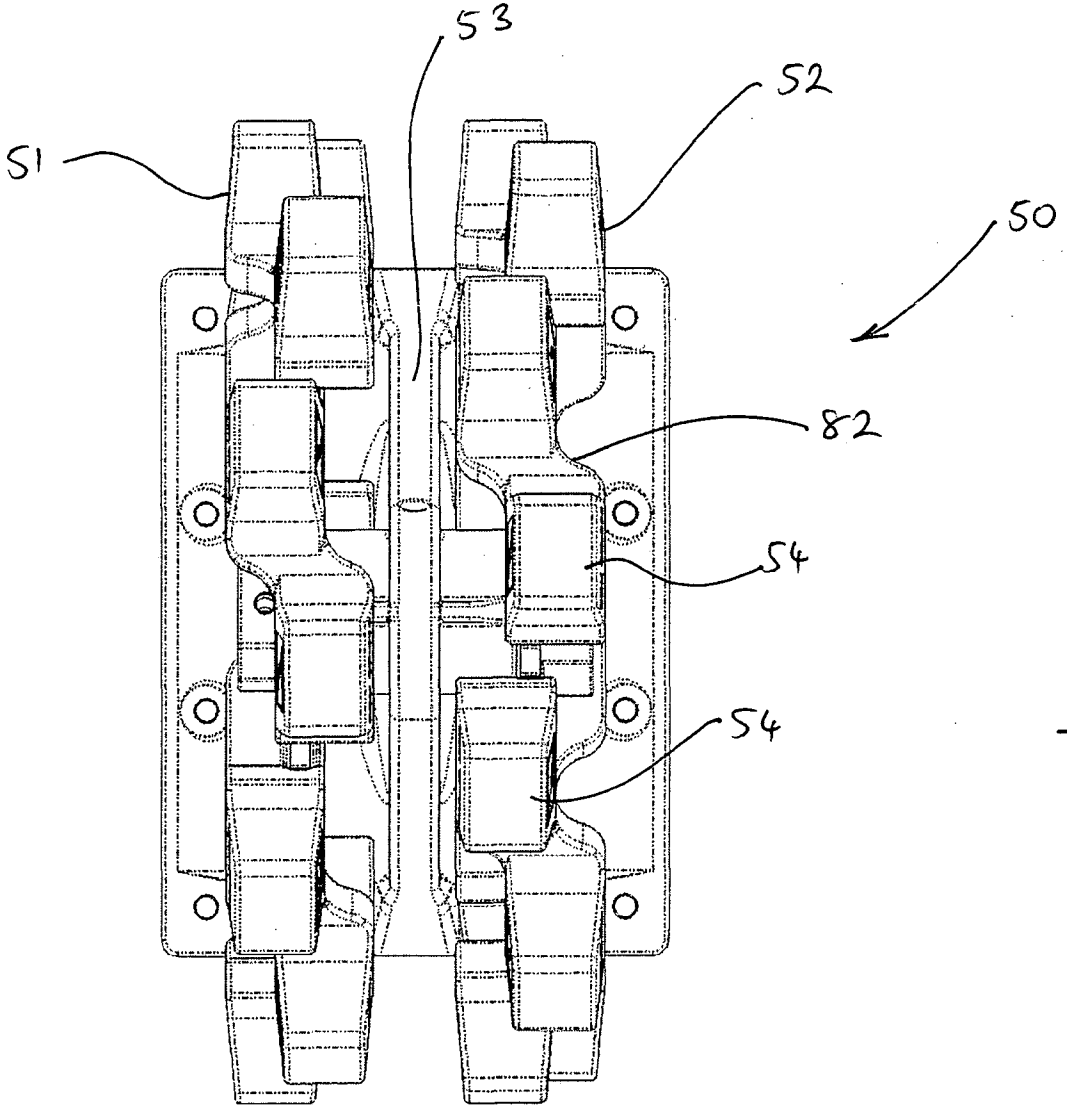
FIG. 6 is a view from below of the embodiment shown in FIG. 5.
Figure 7:
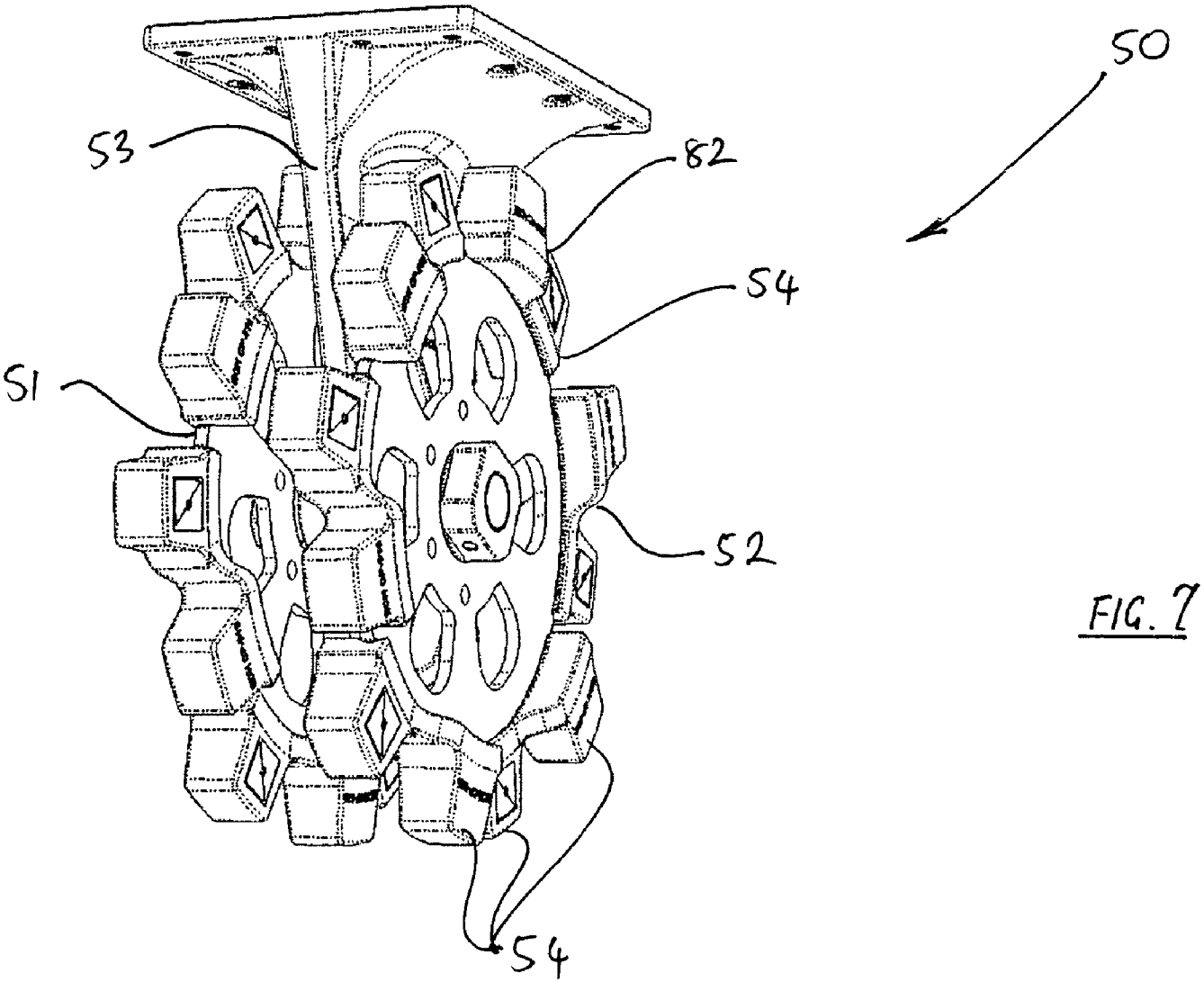
FIG. 7 is a perspective view of the embodiment shown in FIG. 5.
Figure 8:
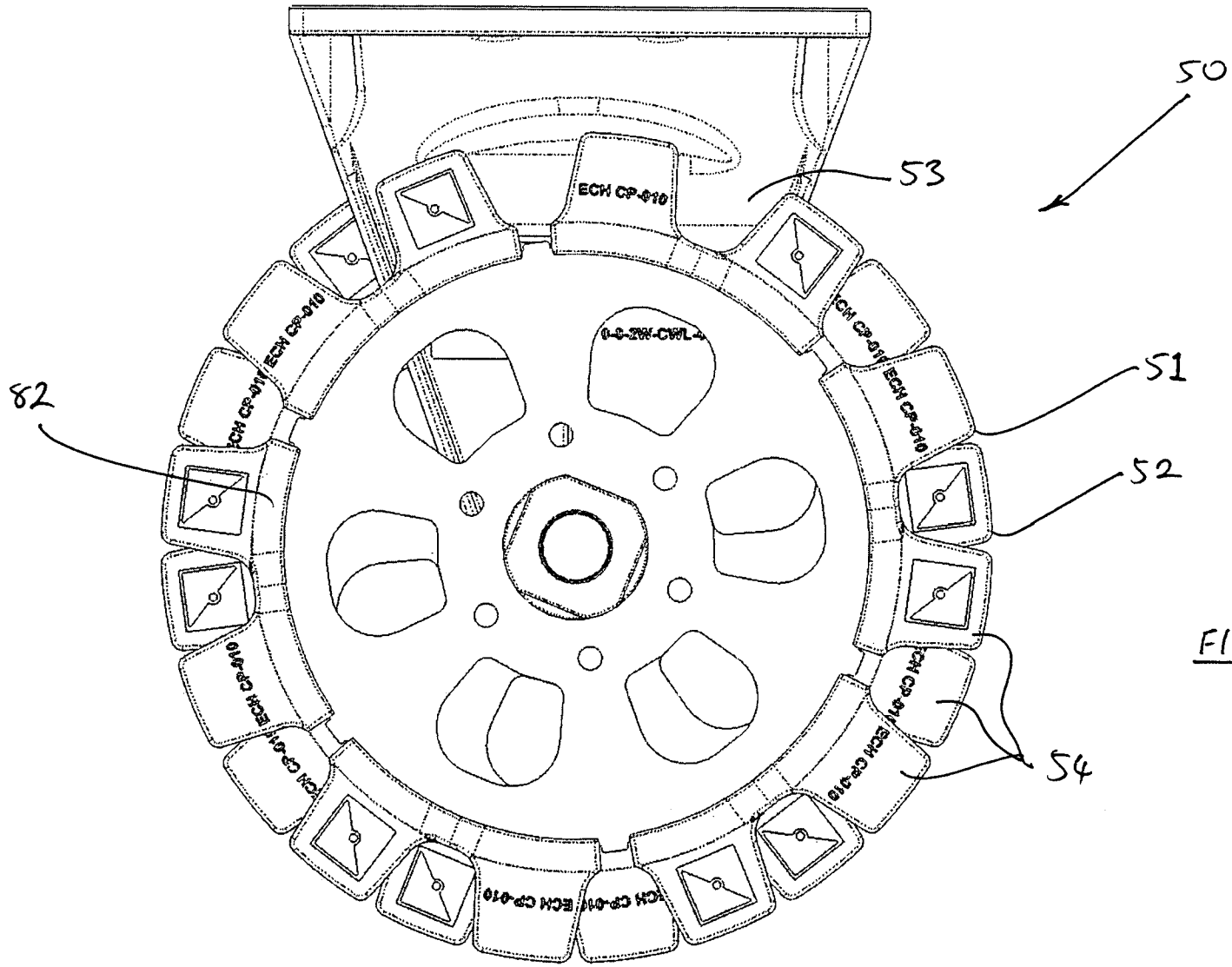
FIG. 8 is a side view of the embodiment shown in FIG. 5.

FIG. 4 shows a compacting device 40 in accordance with an embodiment of the present invention. The device 40 is shown as having three individual wheels 41, 42 and 43, each with feet 44 that are staggered in essentially the same way as the feet 29*a* of the embodiment as shown in FIG. 3. Wheels 41-43 are mounted to a single shaft (not shown) so as to rotate together as a unit, about a transverse axis 45. Bearing assemblies 46 support the shaft and are themselves held by support members 47. Support members 47 extend from a base 48 that is able to be secured (for example via a quick-hitch arrangement of known type, not shown) to an excavator stick in a similar manner to that shown for device 1 in FIG. 1.

It will be appreciated that compacting devices according to the present invention may employ any number of individual wheels, and are not limited to having three wheels. Different numbers of individual wheels may be used to suit different work conditions, different trench widths and different supporting machinery. FIGS. 5 to 8 show a compacting device 50 having two wheels 51 and 52 and only one supporting member 53 positioned therebetween. Device 50 is otherwise similar to device 40, especially in relation to the arrangement of the feet 54 provided on wheels 51 and 52, and in this embodiment the wheels 51 and 52 also rotate together.

Figure 9:
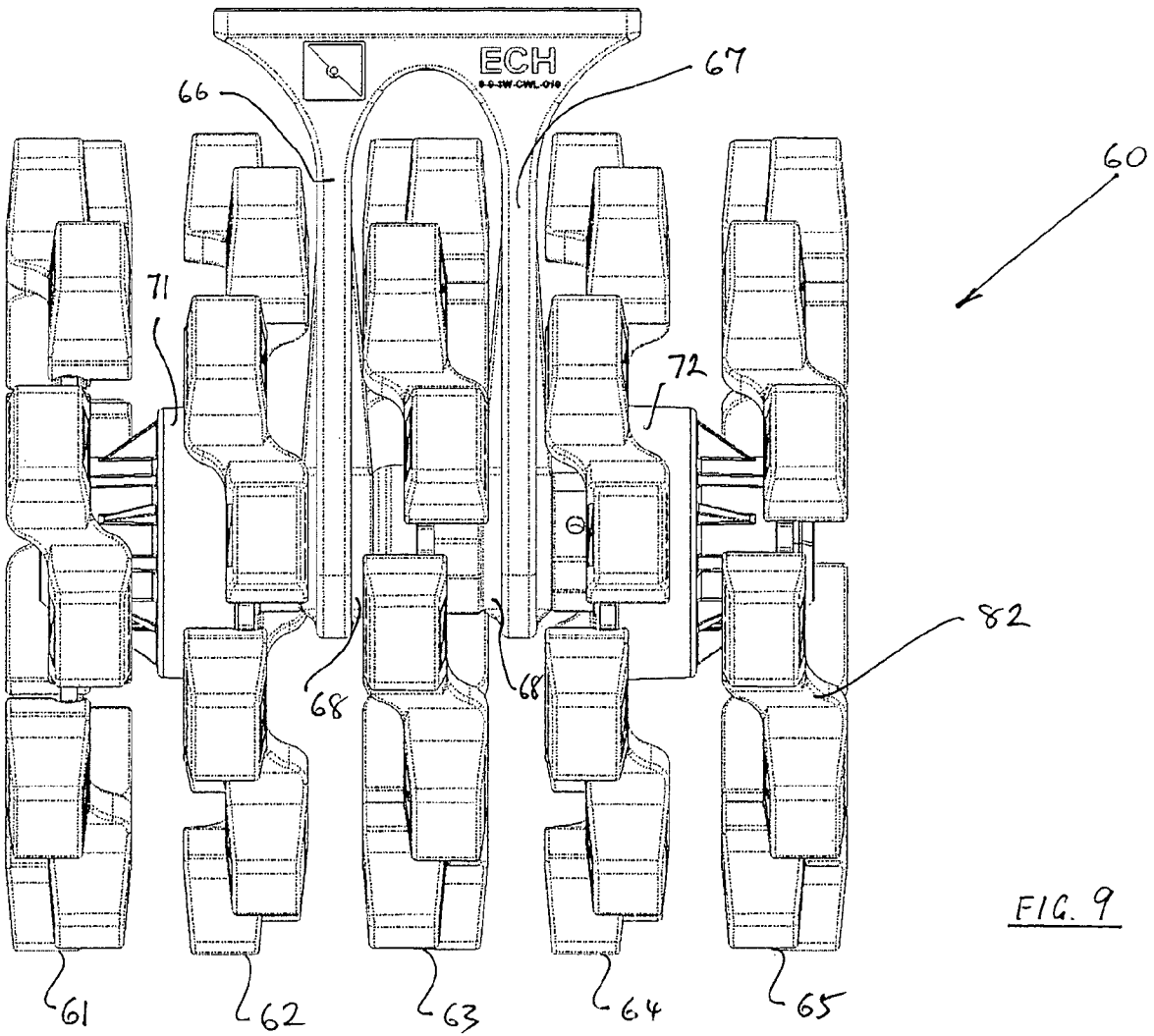
FIG. 9 is an elevation of a five-wheel embodiment of the invention.
Figure 10:
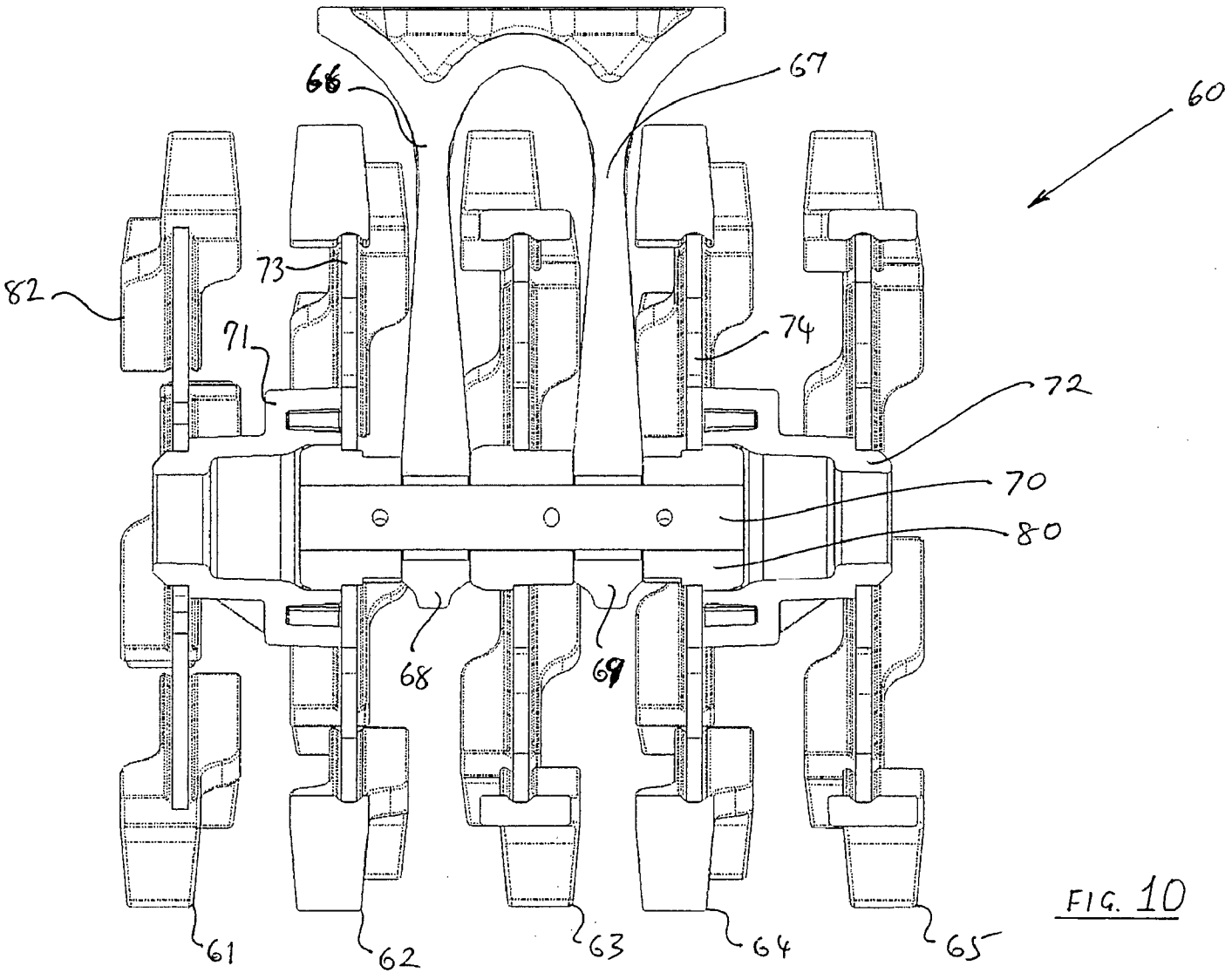
FIG. 10 is a cross-sectional view of the embodiment shown in FIG. 9, the section being taken at the centre of a shaft mounting wheels of the device.
Figure 11:
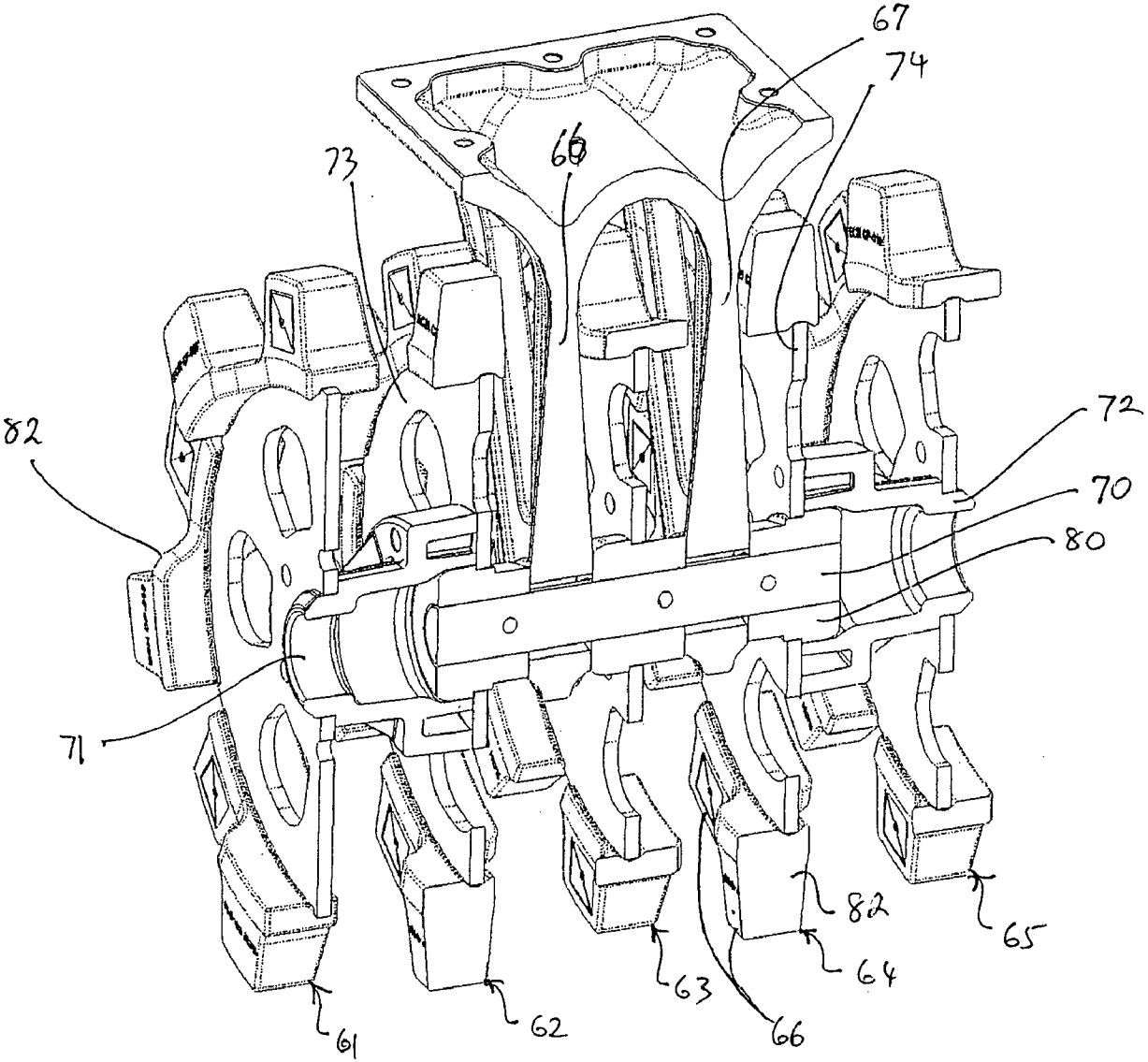
FIG. 11 is a perspective view of the embodiment shown in FIG. 9, partially cut away.

FIGS. 9, 10 and 11 show another embodiment of a compacting device 60 according to the present invention. Device 60 has a total of five wheels, 61, 62, 63, 64 and 65, similar in their arrangement of feet 66 to wheels 41-43 of device 40. Device 60 has only two support members 66 and 67, having bearing assemblies 68 and 69 mounted respectively thereto. Support members 66, 67 and bearing assemblies 68, 69 are located between, firstly, wheels 62 and 63, and, secondly, 63 and 64. As can be seen in the sectional views of FIGS. 10 and 11, wheels 62, 63 and 64 are mounted to a single shaft 70 to rotate together. The outer wheels 61 and 65 are not mounted directly to shaft 70 but to hubs 71 and 72, that are in turn bolted to wheel discs 73 and 74 respectively of wheels 62 and 64. With this arrangement, outer wheels 61 and 65 are readily detachable so that device 60 is convertible to the narrower three-wheel device 40, as required. This feature allows a narrow trench to be accommodated, or higher compaction with a given supporting machine weight, using three wheels 62-64 only when required or, alternatively, a wider trench can be accommodated using all five wheels 61-65.

Figure 15:
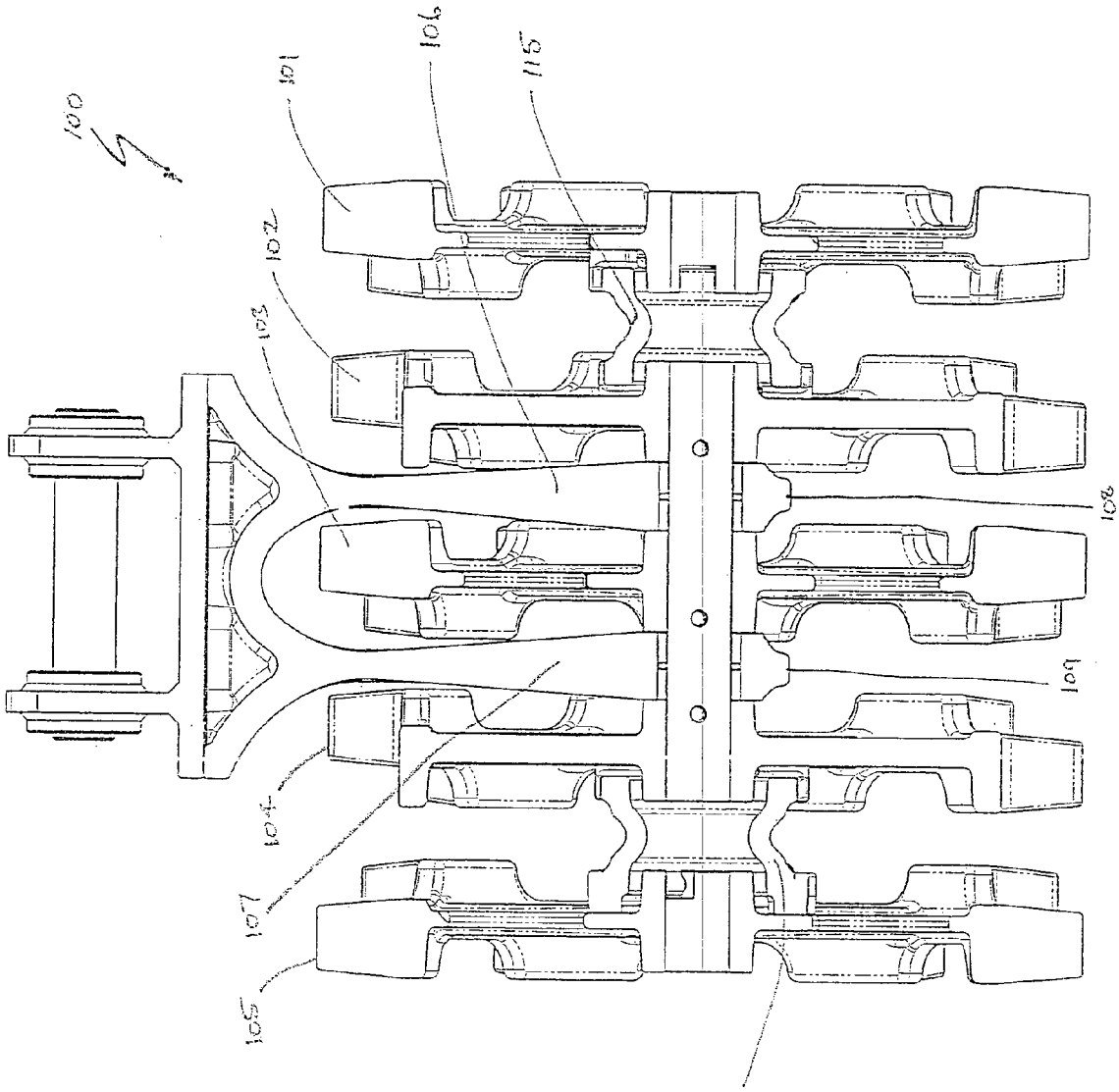
FIG. 15 is a cross-sectional view of an alternative embodiment of a five-wheel compacting device according to the present invention.

FIG. 15 shows an alternative embodiment of a compacting device 100 according to the present invention. As described the embodiment shown in FIGS. 9-11, device 100 has a total of five wheels 101-105. End wheels 101 and 105 are removable to enable the device 100 to be readily converted between a wide five-wheeled device and a narrow three-wheeled device, according to the requirements of the job to be performed. In this regard, device 100 also has two support members 106, 107 having bearing assemblies 108, 109 respectively mounted to an end thereof. A shaft 110 extends through the bearing assemblies 108, 109, and wheels 102, 103 and 104 are mounted to the shaft 110 to rotate about the axis of the shaft 110.

Figure 16:
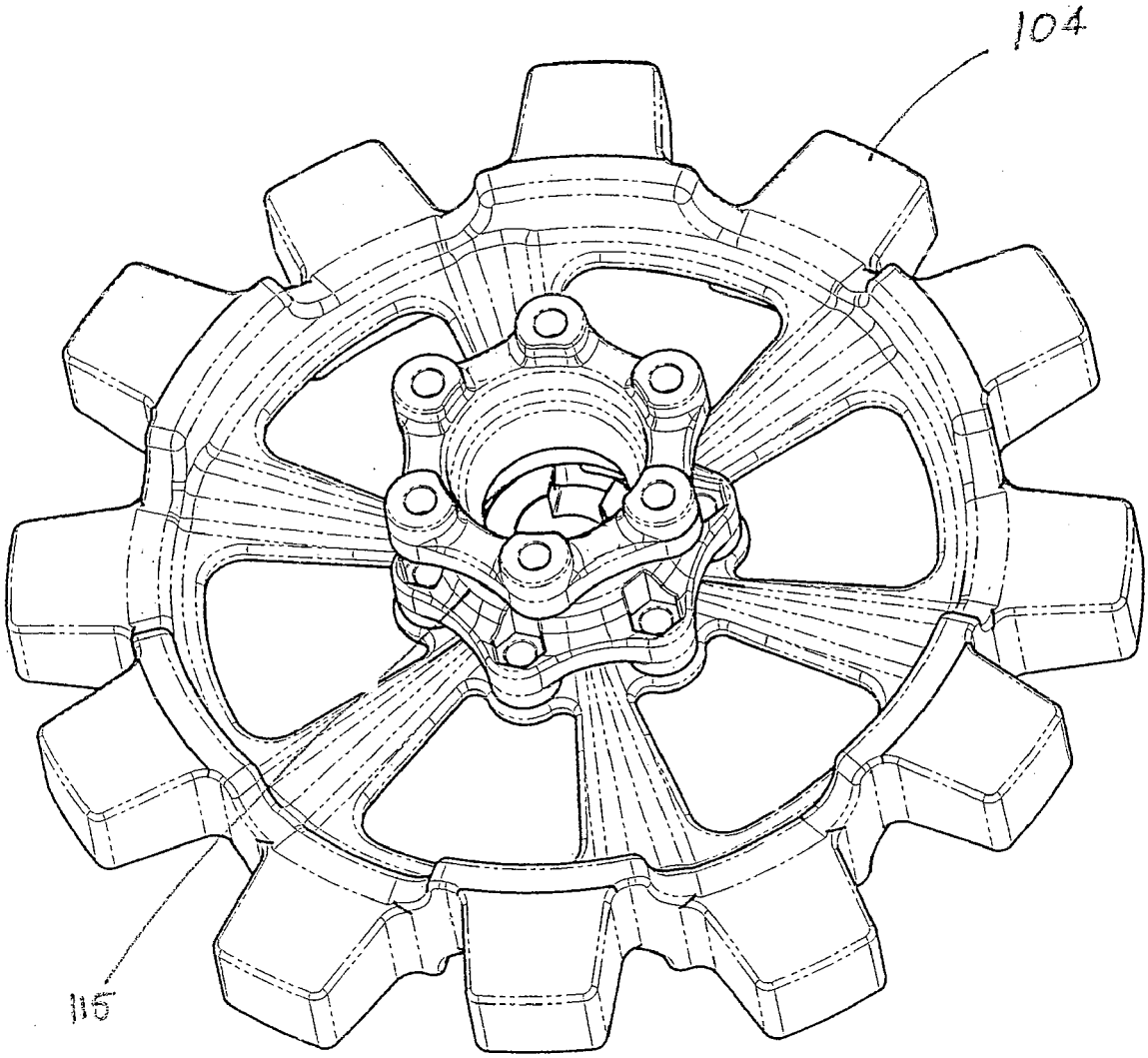
FIG. 16 is an isolated perspective view of a mounting hub mounted to a wheel in accordance with the embodiment of the device shown in FIG. 15.

The end wheels 101 and 105 are respectively mounted to the shaft mounted wheels 102 and 104 by way of mounting hubs 115. The mounting hubs 115 are mounted to the wheel discs of the wheels by appropriate bolts which allow ready attachment/detachment of the end wheels 101 and 105, when required. This is shown in FIG. 16 wherein mounting hub 115 is mounted to the wheel disc 104*a* of wheel 104, in readiness to receive wheel 105.

Figure 17:
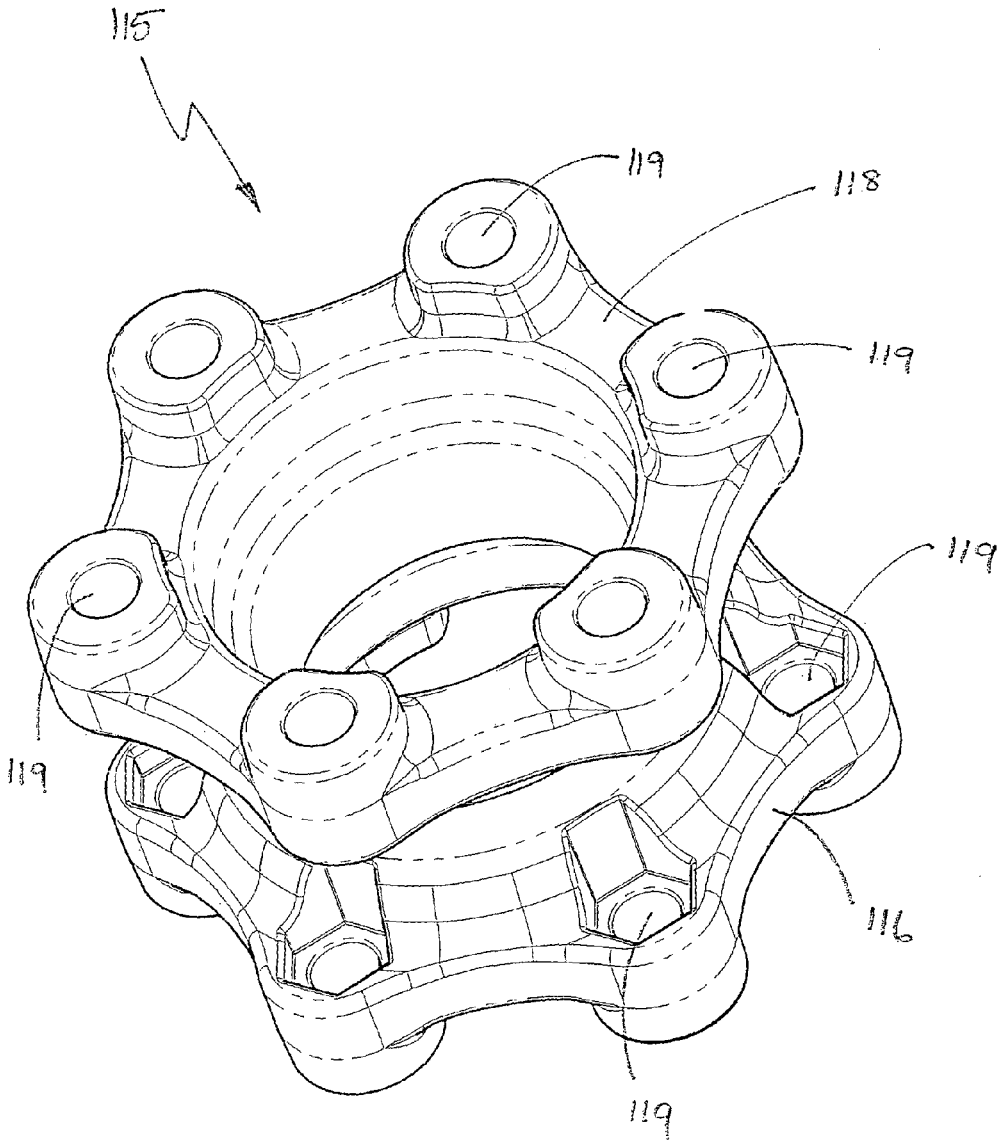
FIG. 17 is perspective view of the mounting hub of FIG. 16.
Figure 18:
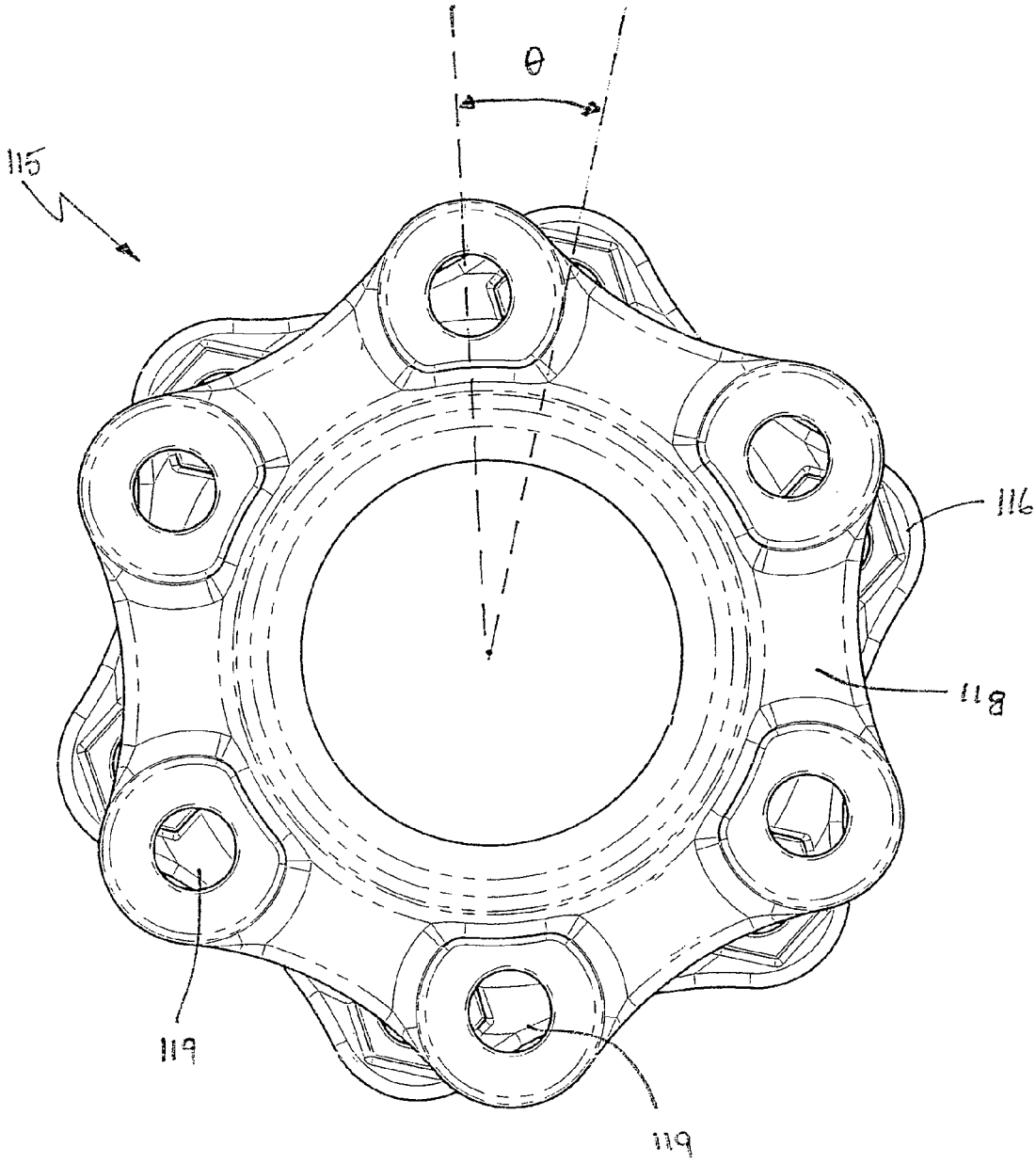
FIG. 18 is a plan view of the mounting hub of FIG. 17.

Mounting hub 115 is shown in more detail in FIGS. 17 and 18 and comprises a pair of mounting cups/discs 116, 118 separated by a central core 117. Each mounting cup/disc 116, 118 is mounted to a wheel disc of the corresponding wheel pairs 104/105 and 101/102 such that rotation of the shaft mounted wheel 102, 104 is transferred to the corresponding end wheel 101, 105. To facilitate mounting of the cups/discs 116, 118 to the wheel discs, a plurality of holes 119 are formed around the periphery of each cup/disc to receive a fastener such as a bolt or the like. Holes 119 align with holes formed in the wheel discs of the wheels such that the fastener can pass through the wheel discs and cups 116, 118.

As shown more clearly in FIG. 18, the holes 119 provided around the periphery of the cup/disc 116 are offset with respect to corresponding holes 119 provided around the periphery of cup/disc 118. In the embodiment as shown the corresponding holes 119 are offset an angle θ with respect to the central axis of the mounting hub 118. This offset angle θ is preferably between around 10° and 20°, more preferably 15°.

Such an offset angle between corresponding holes 119 formed in the periphery of the cups/discs 116, 118, ensures that when wheels 101/102 and wheels 104/105 are mounted together by way of the mounting hub 115, the contacting feet of adjacent wheels are arranged in a circumferentially staggered manner. As discussed above, such a circumferentially staggered arrangement of contacting feet between adjacent wheels aids in facilitating improved soil compaction as the device 100 is rolled over the soil surface in multiple passes.

Figure 19:
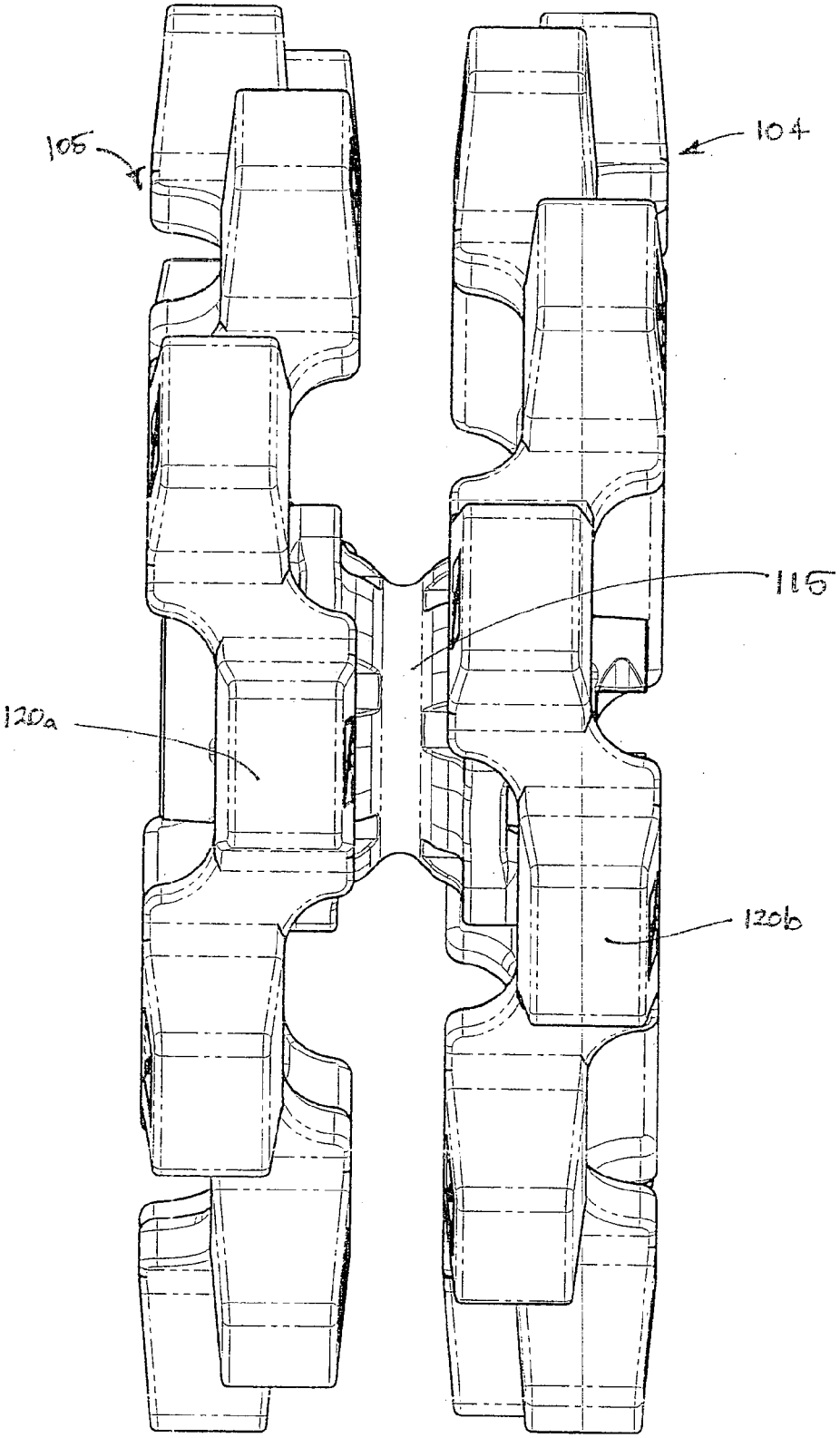
FIG. 19 is a plan view of the mounting hub of FIGS. 16 and 17 connecting adjacent wheels of a compacting device of the present invention.

This circumferential staggered arrangement of the contacting feet of adjacent wheels can be seen more clearly in the isolated view of FIG. 19. As shown, end wheel 105 is mounted to wheel 104 by way of mounting hub 115 in the manner as discussed above. When mounted in this manner, the contacting feet 120*a* of end wheel 105 are circumferentially offset with respect to the contacting feet 120*b* of wheel 104. In this regard, when the device 100 is rolled over the soil to be compacted such that the adjacent wheels rotate together, the corresponding feet 120*a* and 120*b* on adjacent wheels do not contact and pass over the soil at the same time. This avoids the formation of a common path or plane of soil compaction extending orthogonal to the direction in which the device travels, which can cause corrugation in the compacted soil and inconsistent compaction.

One embodiment of the construction of the wheels of the compacting devices according to the present invention will now be described. This construction can be best seen in the sectioned views of FIGS. 10 and 11 that show wheels 61-65. However, it is to be understood that essentially the same construction can be used in the wheels 41-43 of device 40, wheels 51, 52 of device 50, and wheels 101-105 of device 100.

Figure 12:
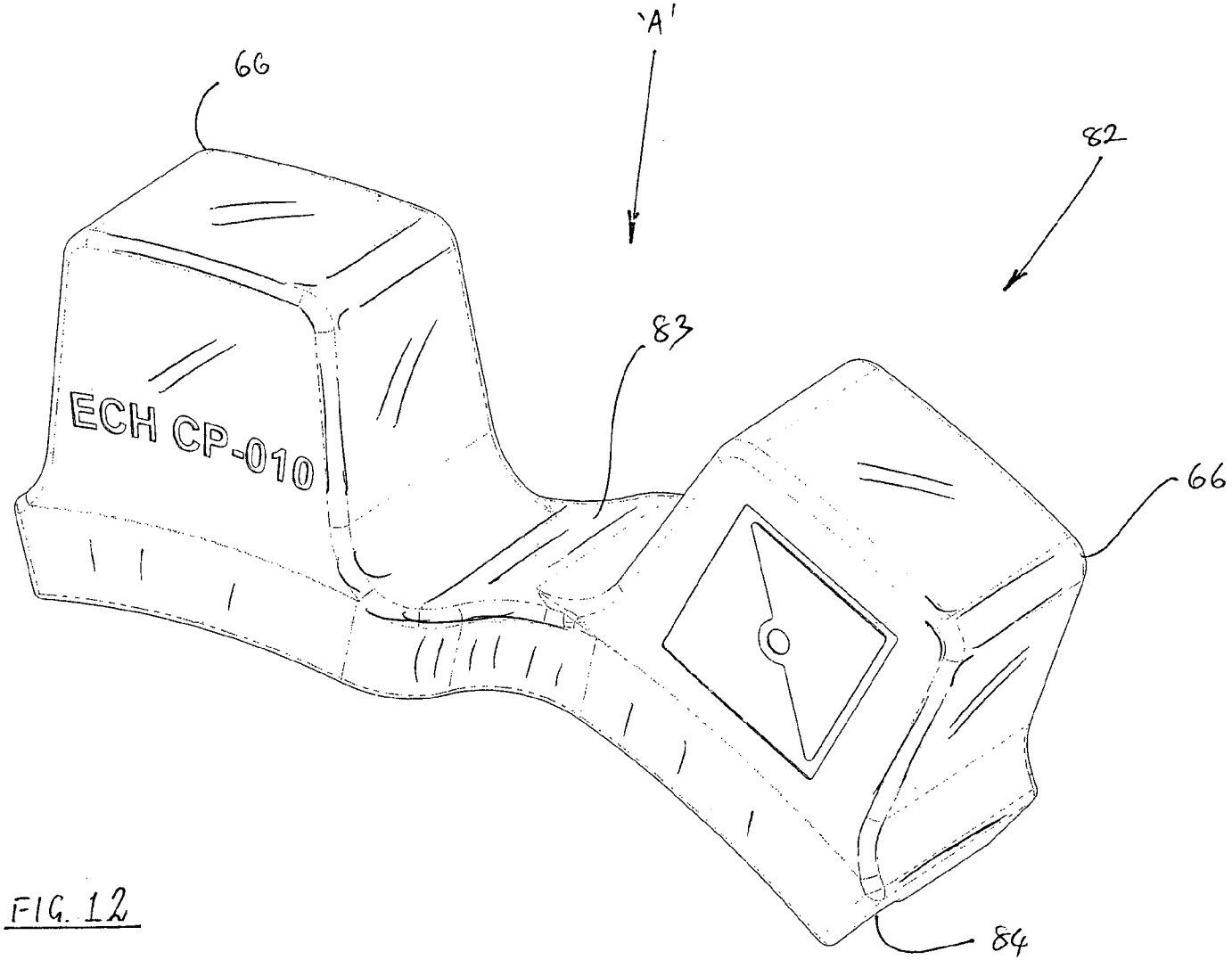
FIG. 12 is a perspective view of a foot assembly of a compacting device according to the invention.
Figure 13:
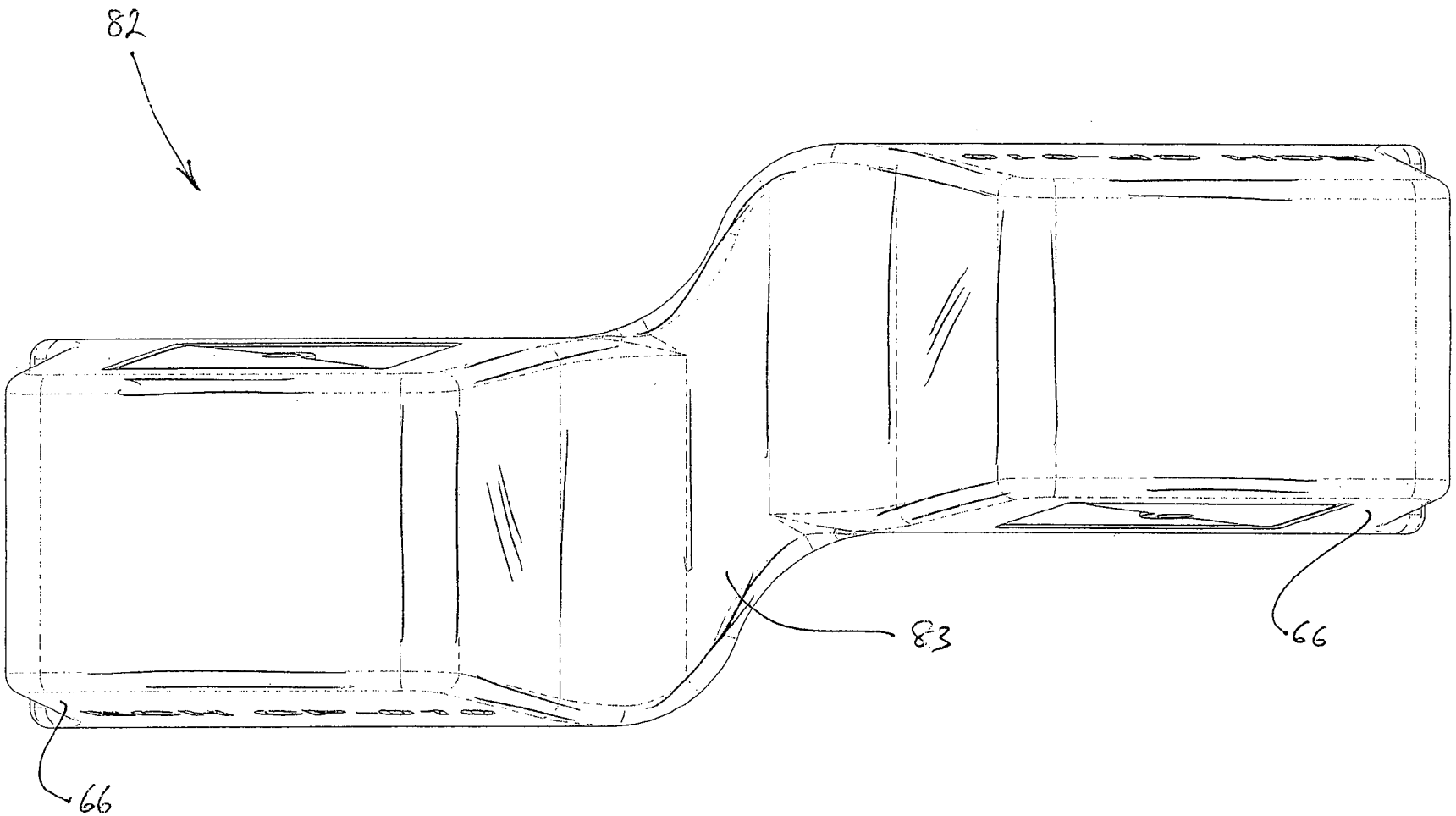
FIG. 13 is a view of the foot assembly shown in FIG. 12, looking in the direction of arrow "A"
Figure 14:
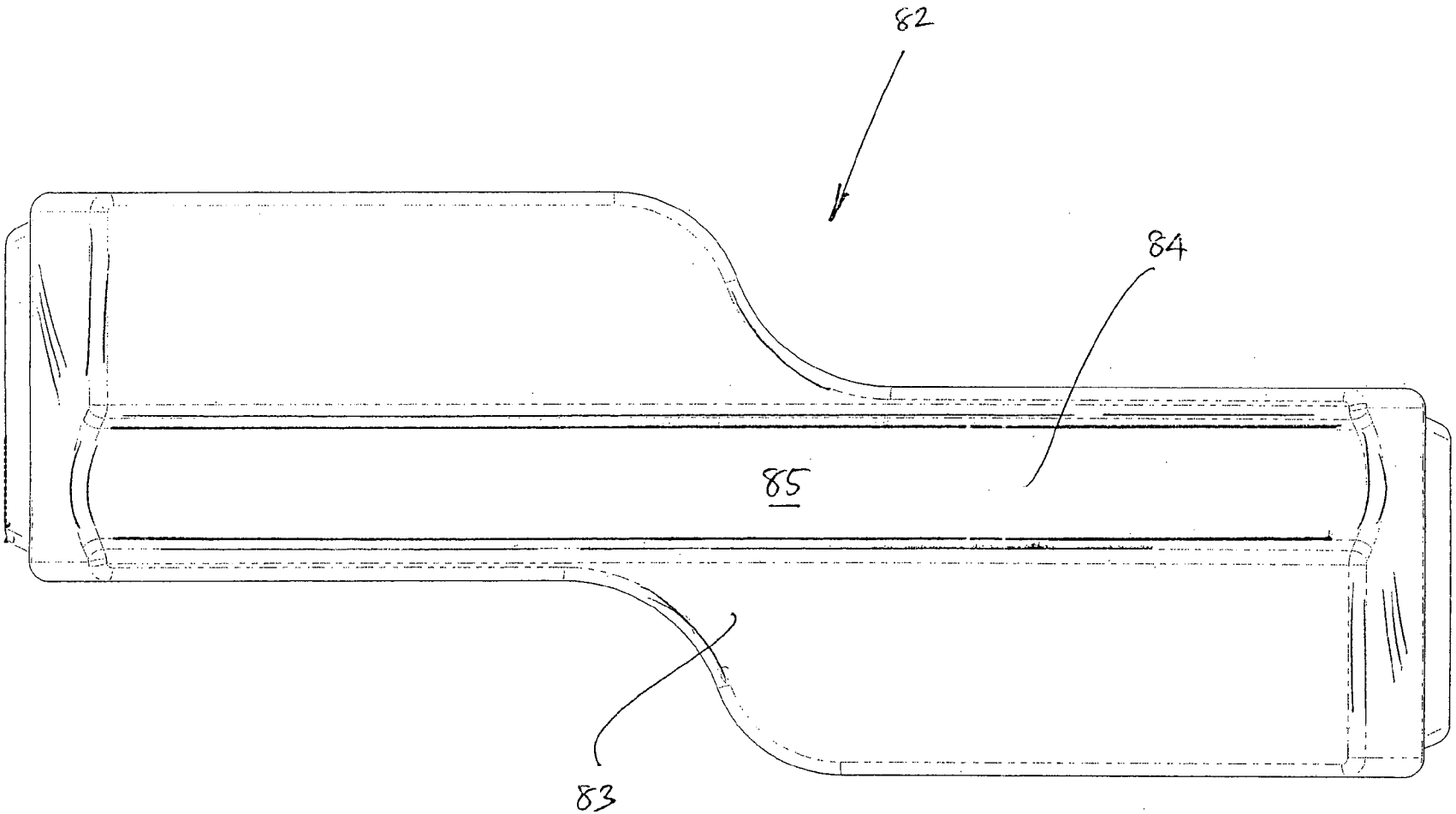
FIG. 14 is a view of the foot assembly shown in FIG. 12 looking in the direction of arrow "B"

Wheel 64 will be described by way of illustration. Wheel 64 has a hub 80 that is secured (by any suitable means known in the art such as a key or pin, not shown) to shaft 70. A wheel disc 74 is then secured to hub 80. This could be achieved by welding or bolting the wheel disc 74 to the hub 80 or by any other suitable manner known in the art. Alternatively, hub 80 and wheel disc 74 could be integrally formed, for example by casting. Secured to the outer edge of wheel disc 74 are foot assemblies 82, each of which includes two feet 66. The feet 66 of each foot assembly 82 are offset from each other in an axial direction (i.e. a direction parallel to shaft 70 in device 60). FIGS. 12, 13 and 14 show one embodiment of the foot assembly 82.

Foot assembly 82 is advantageously a single casting and has a base 83 that connects feet 66 and has an arc that which generally conforms to the arc of the circumference of the wheel disc 74. Formed within base 83 is a groove 84 that is shaped and sized to snugly receive an outer peripheral part of wheel disc 74. Foot assembly 82 can be secured to wheel disc 74 by positioning it on disc 74 so that the disc 74 is received in groove 84 with the outer circumferential edge of disc 74 abutting surface 85 of groove 84, and then welding assembly 82 to disc 74. This process is repeated for each of the assemblies 82 required to be secured around the periphery of wheel disc 74. Assembly 82 is shown in use in devices 40, 50 and 60.

It will be apparent to persons skilled in the art that, as an alternative, an assembly similar to assembly 82, namely having two offset feet 66, could be made that would be able to be secured to wheel disc 74 by bolting therethrough or by pinning, rather than welding. The assemblies 82 may also be formed integral with the wheel disc 74, by casting or other such methods. It will also be apparent that different numbers of feet than the two feet 66 could be incorporated in an alternative design of foot assembly (not shown) if required.

It will also be apparent that if the depth of groove 84 is suitably chosen, a foot assembly such as assembly 82 could be mounted to a range of diameters of wheel disc 74.

Figure 20:
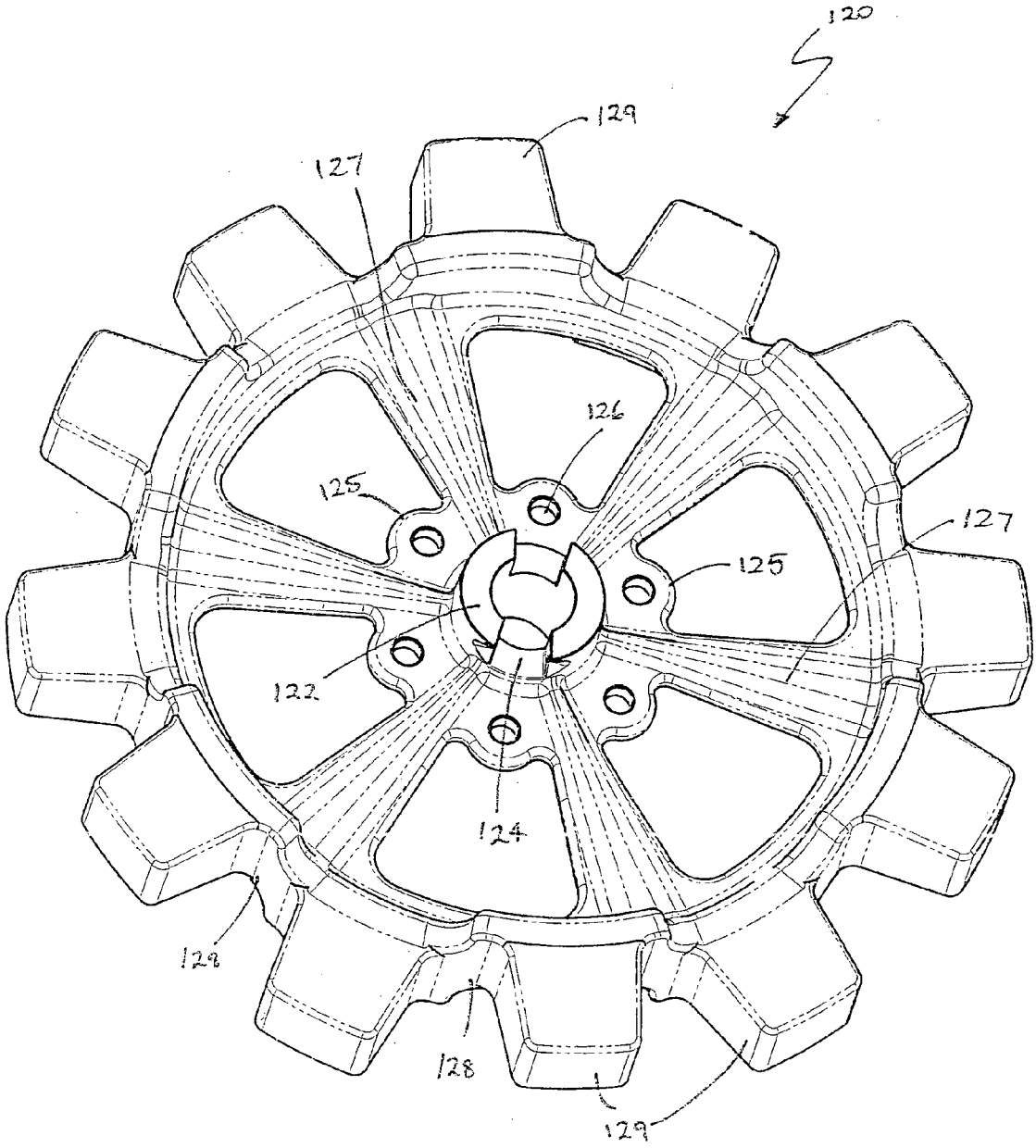
FIG. 20 is a perspective view of a wheel of a compacting device in accordance with one embodiment of the present invention.

An alternative wheel construction is shown in FIG. 20 as wheel 120. Wheel 120 is cast as a single unit and includes an integral hub 122 that is adapted to be secured to a shaft of the device in a manner discussed below. A wheel disc 125 is formed about the hub 122 and has a plurality of holes 126 formed therethrough for mounting a mounting hub 115 in the manner as described above. A plurality of radial spoke elements 127 extend from the wheel disc 125 and hub 122 and terminate in an external rim 128. A plurality of contacting feet 129 extend from the outer surface of the rim 28, and each of the feet 129 are offset from each other in an axial direction (i.e. in a direction parallel to a shaft extending through the hub 122). The feet 129 function in the same manner as the feet 66 discussed above and have the same general shape characteristics.

Figure 21:
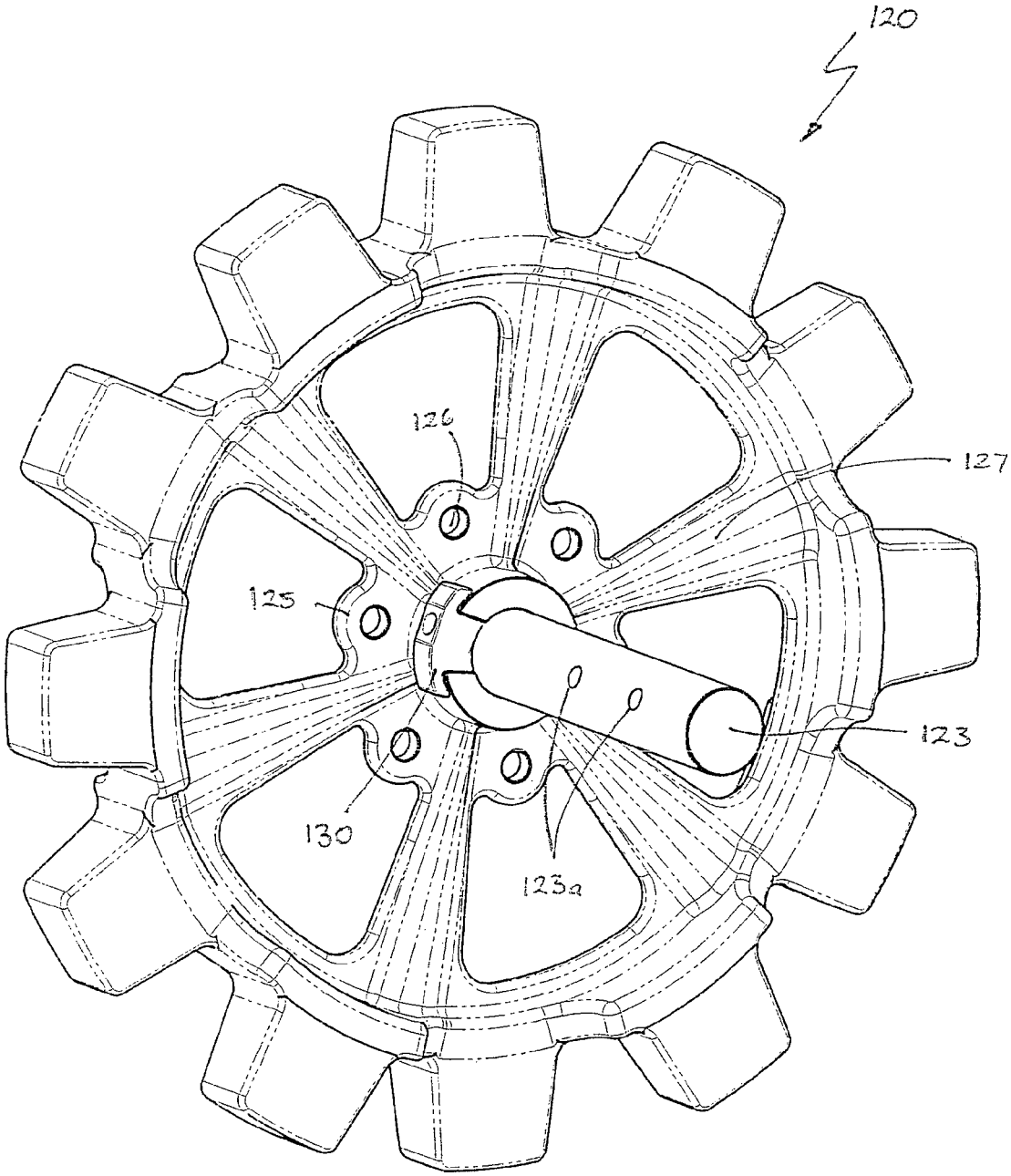
FIG. 21 is a perspective view of the wheel of FIG. 20 mounted to a shaft of a compacting device by way of a locating block in accordance with an embodiment of the present invention.
Figure 22A:
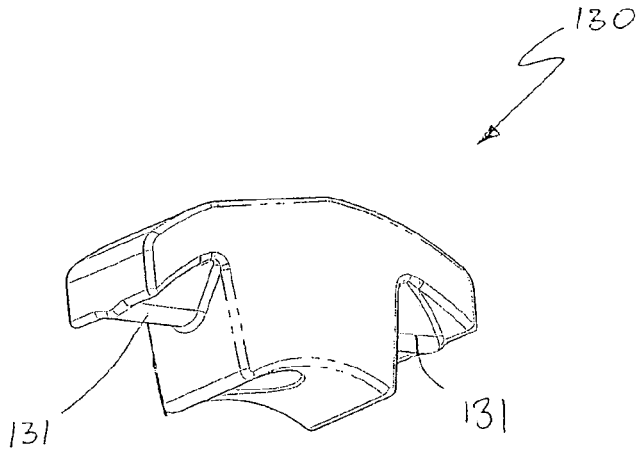
FIGS. 22A-22C show perspective, plan and cross-sectional views of an embodiment of the locating block of FIG. 21.
Figure 22B:
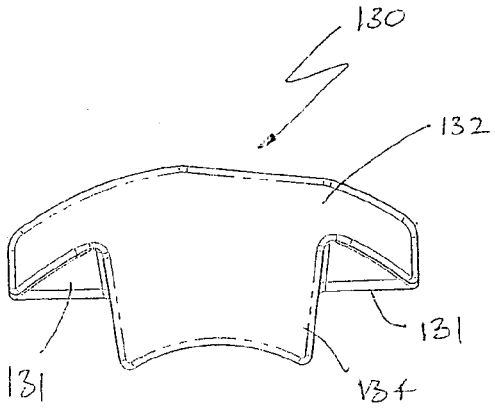

The hub 122 has a pair of opposing recess portions 124 formed therein to facilitate mounting of the wheel 120 to a shaft 123. As shown in FIG. 21, each recess portion 124 is shaped to receive a locating block 130. The locating block 130 is shown in more detail in FIGS. 22A-22C and is generally in the form of a wedge or insert having a head portion 132 and a body portion 134. The body portion 134 is shaped to fit into the recess portion 124 such that the distal end of the body portion 134 abuts the shaft 123, as shown in FIG. 21. The head portion 122 is shaped to abut the surface of the hub 122 and has a pair of V-shaped wings 131 which are snugly received in a pair of V-shaped grooves formed in the surface of the hub 122. Such an arrangement provides a snug fit between the locating block 130 and the hub 122, such that the locating block 130 is able to be simply aligned into the recess portion 124.

Figure 22C:
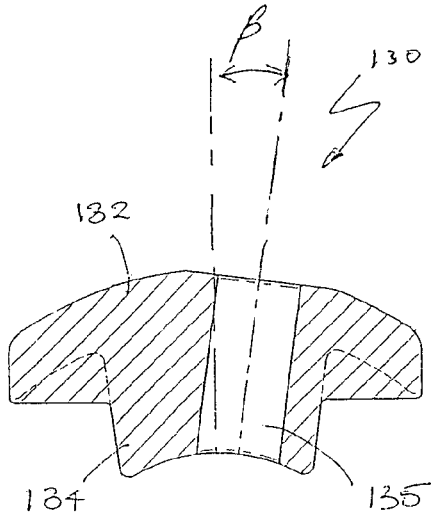

In order to secure the wheels 120 to the shaft 123, holes **123*a* are provided through the shaft 123, as shown in FIG. 21. The holes 123*a* are provided at desired positions along the length of the shaft 123 and orientated in the same manner, for ease of construction. As shown in FIG. 22C, each locating block 130 has a hole 135** formed therethrough.

To assemble the device, the wheels 120 are positioned on the shaft 123 and the locating blocks are inserted into the recess portions 122 such that the hole 135 formed in the locating blocks aligns with the hole **123*a* formed in the shaft 123. A suitable pin or key may then be inserted through the aligned holes 135 and 123*a* to secure the wheel 120 in position on the shaft 123**.

Such an arrangement overcomes the need to drill precise holes through the hub 122, which can be difficult due to the orientation and size of the hub 122 and the tolerances required. Further, in order to orientate adjacent wheels 120 of the device such that the feet 129 of adjacent wheels 120 are arranged in a circumferentially staggered manner, it would be necessary to drill holes through the hub at different positions for each wheel 120, such that when the wheels are secured to the shaft 123 they are correctly orientated with respect to neighbouring wheels.

By employing the locating blocks 130 of the present invention adjacent wheels can be relatively easily positioned and secured in place such that the contacting feet 29 of adjacent wheels are circumferentially staggered, in the manner as shown in FIG. 19. This is achieved through forming the holes 135 in the locating block 130 at an angle β to the vertical axis, as shown in FIG. 22C. Such an orientation of the holes 135 provides a relatively simple way in which to control the orientation of adjacent wheels 120 when secured to the shaft 123. The angle β can vary to provide a variety of circumferentially staggered arrangements. In a preferred form, in order to ensure that there is a constant 150 stagger between wheels, the angle β may be 7.5°. Therefore by inserting the locating blocks 130 within the recess portion 124 of the hubs 122 of adjacent wheels in opposite orientations, adjacent wheels 120 will have their contacting feet 129 circumferentially staggered by 15°. Such an arrangement enables a single type of wheel 120 and locating block 130 to be supplied for assembling the compacting devices to a variety of needs.

Plain bearings may be used to mount devices such as 40, 50, 60, 100, and 120 to their support members 47, 53, 66, 67, 106, and 107. These may use suitable plastics bushes. Alternatively, rolling element bearings may be used.

Although for each of the devices 40, 50, 60, 100 and 120 the wheels 41-42, 51-53, 61-65, and 101-105 have been described as rotating together, it is possible as an alternative to arrange for some or all of the wheels to be allowed to rotate separately.

The present invention provides various embodiments of a soil compacting device that can be readily attachable to a variety of machines to achieve improved soil compaction through greater distribution of soil compacting forces to the soil being compacted. The devices are constructed in a manner that enables the compacting wheels to be relatively easily attached/detached from the device. This facilitates conversion of the device between a narrow device suitable for compacting narrow soil regions, and a wider device suitable for compacting larger surface areas, depending on the type and nature of the task to be performed.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A compacting device for attachment to an earthmoving machine to compact a substrate, the compacting device comprising:

a base adapted to be mounted to said earthmoving machine;

one or more support members extending from the base;

one or more bearings, the or each bearing being mounted to an end of the one or more support members;

a shaft rotatably supported within the one or more bearings; and a plurality of wheel assemblies mountable to said shaft such that said one or more support members extend between said wheel assemblies, at least one wheel assembly of the plurality of wheel assemblies comprising:

a first plurality of ground-contacting feet positioned around the periphery of the at least one wheel assembly at a first axial side of the at least one wheel assembly; and a second plurality of ground-contacting feet positioned around the periphery of the at least one wheel assembly at a second axial side of the at least one wheel assembly opposing the first axial side, wherein a foot of the first plurality of ground-contacting feet is positioned adjacent to and axially offset from an adjacent foot of the second plurality of ground-contacting feet, and wherein an intended rotational path of the foot of the first plurality of ground-contacting feet axially overlaps an intended rotational path of the adjacent foot of the second plurality of ground-contacting feet, wherein the at least one wheel assembly of the plurality of wheel assemblies further comprises a plurality of foot assemblies, each comprising a foot of the plurality of ground-contacting feet and an adjacent foot of the second plurality of ground-contacting feet and secured to the rim portion of each wheel assembly.

2. A compacting device according to claim 1 wherein each wheel assembly of the plurality of wheel assemblies comprises a first plurality of ground-contacting feet and a second plurality of ground-contacting feet, the first plurality of ground-contacting feet and the second plurality of ground-contacting feet being peripherally spaced apart around a rim portion of each respective wheel assembly such that when said device is rolled over the substrate the first plurality of ground-contacting feet contact the substrate between axial width limits that differ from axial width limits of the second plurality of ground-contacting feet.

3. A compacting device according to claim 2 wherein the axial width limits of the first plurality of ground-contacting feet of each wheel assembly partially overlap the axial width limits of the second plurality of ground-contacting feet of each wheel assembly.

4. A compacting device according to claim 2 wherein each foot of the first plurality of ground-contacting feet is positioned adjacent to a foot of the second plurality of ground-contacting feet.

5. A compacting device according to claim 1, wherein each foot assembly consists of the foot of the first plurality of ground-contacting feet and the adjacent foot of the second plurality of ground-contacting feet.

6. A compacting device according to claim 1, wherein the foot of the first plurality of ground-contacting feet and the adjacent foot of the second plurality of ground-contacting feet are integrally formed in each foot assembly.

7. A compacting device according to claim 6 wherein each foot assembly is secured to the rim portion of the wheel assembly by at least one of welding, bolting, riveting, and pinning by means of at least one pin.

8. A compacting device according to claim 6 wherein each foot assembly is formed integrally with the rim portion of the wheel assembly.

9. A compacting device according to claim 1, wherein each foot assembly has locating surfaces that when the foot assembly is placed on said rim portion of the wheel assembly for securing thereto bear against said rim portion of the wheel assembly so as to correctly position the foot assembly radially and/or axially on said rim portion of the wheel assembly.

10. A compacting device according to claim 9 wherein each foot assembly has a groove within which the rim portion of the wheel assembly is close-fittingly received so as to locate the foot assembly on said rim portion of the wheel assembly axially and radially.

11. A compacting device according to claim 1, wherein when each foot assembly is secured to said rim portion of the wheel assembly the axially leftmost width limit of the foot of the first plurality of ground-contacting feet is on an opposite side of the rim portion of the wheel assembly from the axially rightmost width limit of the adjacent foot of the second plurality of ground-contacting feet.

12. A compacting device according to claim 1, wherein the foot and the adjacent foot of each foot assembly have approximately the same shape as each other except for being oppositely handed in an axial direction and wherein when each foot assembly is secured to said rim portion of the wheel assembly the foot and the adjacent foot of the foot assembly are approximately equally displaced in opposite axial directions from the rim portion of the wheel assembly.

13. A method for compacting soil including the steps of:

securing a compacting device according to claim 1 to an earthmoving machine;

utilizing said machine to roll said device back and forth on a surface of the soil.

14. A method according to claim 13 wherein the earthmoving machine comprises a backhoe mechanism having a boom and a dipper and wherein the device is secured to a free end of the dipper.

15. A compacting device according to claim 1 wherein the wheel assemblies are mountable to the shaft such that the ground contacting feet of adjacent wheel assemblies are circumferentially staggered.

16. A compacting device according to claim 15, wherein at least two of the wheel assemblies are directly mounted to the shaft.

17. A compacting device according to claim 16, wherein at least one wheel assembly is mounted to one of the wheel assemblies directly mounted to the shaft.

18. A compacting device according to claim 1 wherein one or more additional wheel assemblies are removably mounted to one or more of the plurality of wheel assemblies mounted on the shaft.

19. A compacting device according to claim 18, wherein the one or more additional wheel assemblies are removably mounted to an end wheel assembly mounted on the shaft.

20. A compacting device according to claim 19, wherein the one or more additional wheel assemblies are removably mounted to a hub which is removably mounted to said end wheel assembly mounted on the shaft.

21. A compacting device according to claim 18, wherein each of the plurality of wheel assemblies and the one or more additional wheel assemblies include a plurality of ground-contacting feet spaced apart around the periphery of each wheel assembly and alternately displaced laterally towards opposing sides of the wheel assembly.

22. A compacting device for attachment to an earthmoving machine to compact a substrate, the compacting device comprising:

a base adapted to be mounted to the earthmoving machine;

one or more support members extending from the base;

one or more bearings, the or each bearing being mounted to an end of the one or more support members;

a shaft rotatably supported within the one or more bearings; and a plurality of wheel assemblies mountable to the shaft such that the one or more support members extend between the wheel assemblies, at least one wheel assembly of the plurality of wheel assemblies comprising:

a first plurality of ground-contacting feet positioned around the periphery of the at least one wheel assembly at a first axial side of the at least one wheel assembly; and a second plurality of ground-contacting feet positioned around the periphery of the at least one wheel assembly at a second axial side of the at least one wheel assembly opposing the first axial side, wherein a foot of the first plurality of ground-contacting feet is positioned adjacent to and axially offset from an adjacent foot of the second plurality of ground-contacting feet, and wherein an intended rotational path of the foot of the first plurality of ground-contacting feet axially overlaps an intended rotational path of the adjacent foot of the second plurality of ground-contacting feet, wherein each ground contacting foot is formed integral with at least one adjacent ground contacting foot to form a multi-foot pad attached to a rim portion of each wheel assembly.

23. A compacting device according to claim 22 wherein said multi-foot pad has two feet only.

24. A compacting device according to claim 23 wherein said multi-foot pad is secured to the rim portion of the wheel assembly by at least one of welding, bolting, riveting, and pinning by means of at least one pin.

25. A compacting device according to claim 22 wherein said multi-foot pad has locating surfaces that when said multi-foot pad is placed on said rim portion of the wheel assembly for securing thereto bear against said rim portion of the wheel assembly so as to correctly position said feet radially and/or axially on said rim portion of the wheel assembly.

26. A compacting device according to claim 25 wherein said multi-foot pad has a groove within which the rim portion of the wheel assembly is received so as to locate said multi-foot pad on said rim portion of the wheel assembly axially and radially.

27. A compacting device according to claim 22 wherein said first and second feet of said multi-foot pad have substantially the same shape and wherein when said multi-foot pad is secured to said rim portion of the wheel assembly said first and second feet are approximately equally displaced in opposite lateral directions from the rim portion of the wheel assembly.

28. A compacting device for attachment to an earthmoving machine to substrate, the compacting device comprising:

a base adapted to be mounted to the earthmoving machine;

one or more support members extending from the base;

one or more bearings, the or each bearing being mounted to an end of the one or more support members;

a shaft rotatably supported within the one or more bearings; and a plurality of wheel assemblies mountable to the shaft such that the one or more support members extend between said wheel assemblies, at least one wheel assembly of the plurality of wheel assemblies comprising:

a first plurality of ground-contacting feet positioned around the periphery of the at least one wheel assembly at a first axial side of the at least one wheel assembly; and a second plurality of ground-contacting feet positioned around the periphery of the at least one wheel assembly at a second axial side of the at least one wheel assembly opposing the first axial side, wherein a foot of the first plurality of ground-contacting feet is positioned adjacent to and axially offset from an adjacent foot of the second plurality of ground-contacting feet, and wherein an intended rotational path of the foot of the first plurality of ground-contacting feet axially overlaps an intended rotational path of the adjacent foot of the second plurality of ground-contacting feet, wherein one or more additional wheel assemblies are removably mounted to one or more of the plurality of wheel assemblies mounted on the shaft;

wherein the one or more additional wheel assemblies are removably mounted to an end wheel assembly mounted on the shaft;

wherein the one or more additional wheel assemblies are removably mounted to a hub that is removably mounted to said end wheel assembly mounted on the shaft; and wherein the hub comprises a first mounting disc for mounting said hub to a wheel disc of said end wheel assembly mounted on the shaft and a second mounting disc to which is mounted said additional wheel assembly.

29. A compacting device according to claim 28, wherein the first and second mounting discs have a plurality of holes formed therethrough to receive one or more fasteners for facilitating mounting of the hub to the end wheel assembly and the additional wheel assembly to the hub.

30. A compacting device according to claim 29, wherein the plurality of holes are formed around the periphery of the first and second mounting discs.

31. A compacting device according to claim 30, wherein corresponding holes formed in the periphery of the first and second mounting discs are offset such that a plurality of ground-contacting feet spaced apart around the periphery of the additional wheel assembly are circumferentially staggered with respect to a plurality of ground-contacting feet spaced apart around the periphery of the end wheel assembly when the additional wheel assembly is mounted to the end wheel assembly.

32. A multi-foot ground-engaging pad for a compacting device having a wheel assembly comprising one or more wheels adapted to be rolled over a substrate to be compacted, the pad comprising a plurality of ground-engaging feet integrally formed on a base that is securable to a rim portion of the one or more wheels whereupon said feet of the plurality of ground-engaging feet are spaced peripherally on the one or more wheels, wherein successive feet of said plurality of ground-engaging feet on each wheel of the one or more wheels are alternately positioned at opposing sides of the respective wheel, and wherein an intended rotational path of each foot of the plurality of ground-engaging feet partially overlaps with an intended rotational path of an adjacent foot of the plurality of ground-engaging feet.

33. A multi-foot ground engaging pad according to claim 32, wherein said multi-foot pad has two said ground engaging feet only.

34. A multi-foot ground engaging pad according to claim 32, wherein the pad is securable to said wheel by at least one of welding, bolting, riveting, and pinning by means of at least one pin.

35. A multi-foot ground engaging pad according to claim 32, wherein the pad includes locating surfaces that when said pad is placed on said wheel for securing thereto, said locating surfaces bear against said wheel so as to correctly position said ground engaging feet radially and/or axially on said wheel.

36. A multi-foot ground engaging pad according to claim 32 having a groove within which the rim portion of said wheel is received so as to locate said pad on said wheel axially and radially.

37. A multi-foot ground engaging pad according to claim 32 so proportioned that when said pad is secured to said wheel the axially leftmost width limit of said first foot is on an opposite side of said rim portion of said wheel from the axially rightmost width limit of said second foot.

38. A multi-foot ground engaging pad according to claim 37 wherein said first and second feet of said pad have approximately the same shape as each other save for being oppositely handed in an axial direction and wherein when said multi-foot pad is secured to said wheel said first and second ground engaging feet are approximately equally displaced in opposite axial directions from said rim portion of the wheel.

* * * * *

UNITED STATES PATENT AND TRADEMARK OFFICE

CERTIFICATE OF CORRECTION

PATENT NO. : 8,215,867 B2
APPLICATION NO. : 12/227813
DATED : July 10, 2012
INVENTOR(S) : Juzva It is certified that error appears in the above-identified patent and that said Letters Patent is hereby corrected as shown below:

On the title page:

| | |
|---|---|
| In ITEM [75] Inventors: | change both instances of "Dandenong" to --Dandenong South-- |
| After ITEM [65] **Prior Publication Data**, | insert item --[30] **Foreign Application Priority Data**<br>May 31, 2006 (AU) ..... 2006902915-- |

In the claims:

| | |
|---|---|
| CLAIM 28, COLUMN 14, LINE 2, | change "to substrate," to --to compact a substrate,-- |

Signed and Sealed this
Twenty-eighth Day of January, 2014

Michelle K. Lee

Michelle K. Lee
*Deputy Director of the United States Patent and Trademark Office*